US009640355B2

(12) United States Patent
Enomoto et al.

(10) Patent No.: US 9,640,355 B2
(45) Date of Patent: May 2, 2017

(54) CONTACT APPARATUS

(71) Applicant: PANASONIC INTELLECTUAL PROPERTY MANAGEMENT CO., LTD., Osaka (JP)

(72) Inventors: Hideki Enomoto, Nara (JP); Ritsu Yamamoto, Mie (JP); Yoshihisa Fukuda, Osaka (JP); Yohji Ikeda, Hokkaido (JP); Ryosuke Ozaki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/715,213

(22) Filed: May 18, 2015

(65) Prior Publication Data

US 2015/0255236 A1 Sep. 10, 2015

Related U.S. Application Data

(63) Continuation of application No. 13/809,961, filed as application No. PCT/IB2011/000352 on Feb. 23, 2011, now Pat. No. 9,059,523.

(30) Foreign Application Priority Data

Jul. 16, 2010 (JP) ..... 2010-161970
Jul. 16, 2010 (JP) ..... 2010-161973

(51) Int. Cl.
*H01H 9/20* (2006.01)
*H01H 50/60* (2006.01)
(Continued)

(52) U.S. Cl.
CPC ..... *H01H 50/60* (2013.01); *H01H 1/54* (2013.01); *H01H 3/46* (2013.01); *H01H 50/36* (2013.01);
(Continued)

(58) Field of Classification Search
CPC ..... H01H 50/04; H01H 50/22; H01H 50/30; H01H 50/34; H01H 50/36; H01H 50/54;
(Continued)

(56) References Cited

U.S. PATENT DOCUMENTS 2,540,185 A * 2/1951 Brown ..... H01H 51/065 200/250
3,887,888 A 6/1975 Bayles et al.
(Continued)

FOREIGN PATENT DOCUMENTS

AT 18959 11/1986
CN 101620950 1/2010
(Continued)

OTHER PUBLICATIONS

German Office action dated Jan. 22, 2014, along with an English-language translation thereof.
(Continued)

*Primary Examiner* — Shawki S Ismail
*Assistant Examiner* — Lisa Homza
(74) *Attorney, Agent, or Firm* — Greenblum & Bernstein, P.L.C.

(57) ABSTRACT

A contact apparatus is provided and includes fixed terminals having fixed contacts, a movable contact member having the movable contacts provided on one surface thereof so as to come into contact or out of contact with the fixed contacts, a first yoke arranged at one side of said one surface of the movable contact member, and a second yoke arranged at a side of the other surface of the movable contact member, the second yoke having one surface facing the first yoke through the movable contact member. The first yoke is larger in volume than the second yoke.

14 Claims, 18 Drawing Sheets

(51) Int. Cl.

| | |
|---|---|
| ***H01H 1/54*** | (2006.01) |
| ***H01R 13/02*** | (2006.01) |
| ***H01H 50/38*** | (2006.01) |
| ***H01H 3/46*** | (2006.01) |
| ***H01H 50/36*** | (2006.01) |
| *H01H 50/54* | (2006.01) |
| *H01H 50/02* | (2006.01) |

(52) U.S. Cl.
CPC ..... *H01H 50/38* (2013.01); *H01R 13/02* (2013.01); *H01H 50/546* (2013.01); *H01H 2050/025* (2013.01); *H01H 2235/01* (2013.01)

(58) Field of Classification Search
CPC ..... H01H 50/56; H01H 50/60; H01H 50/643; H01H 2050/362; H01H 2235/01
USPC ..... 335/171
See application file for complete search history.

(56) References Cited

U.S. PATENT DOCUMENTS 4,616,202 A 10/1986 Kakizoe
5,049,845 A * 9/1991 Yokoyama ..... H01H 50/548 200/240
5,892,194 A * 4/1999 Uotome ..... H01H 1/34 218/68
6,911,884 B2 6/2005 Uotome et al.
7,157,996 B2 * 1/2007 Enomoto ..... H01H 50/02 335/126
7,852,178 B2 * 12/2010 Bush ..... H01H 51/2209 335/126
7,859,373 B2 12/2010 Yamamoto et al.
7,876,183 B2 1/2011 Uruma et al.
8,138,863 B2 3/2012 Tanaka et al.
8,138,872 B2 3/2012 Yoshihara et al.
8,179,217 B2 * 5/2012 Kawaguchi ..... H01F 7/1615 335/124
8,198,964 B2 * 6/2012 Yoshihara ..... H01H 51/29 335/131
8,269,585 B2 * 9/2012 Choi ..... H01H 1/2008 335/126
8,274,347 B2 * 9/2012 Eum ..... H01H 9/341 335/156
8,549,734 B2 * 10/2013 Yeon ..... H01H 49/00 218/118
9,117,611 B2 * 8/2015 Naka
2004/0027776 A1 * 2/2004 Uotome ..... H01H 47/06 361/160
2007/0241847 A1 * 10/2007 Yamamoto ..... H01H 50/305 335/196
2009/0066450 A1 * 3/2009 Yano ..... H01H 49/00 335/203
2009/0243771 A1 * 10/2009 Uruma ..... H01H 50/04 335/193
2009/0261928 A1 * 10/2009 Nakamura ..... H01H 50/041 335/147
2009/0322454 A1 * 12/2009 Tanaka ..... H01H 1/54 335/189
2009/0322455 A1 * 12/2009 Yoshihara ..... H01F 7/1615 335/189
2011/0032059 A1 * 2/2011 Ito ..... H01H 9/34 335/202
2012/0139670 A1 * 6/2012 Yamagata ..... H01H 50/023 335/2
2013/0012037 A1 * 1/2013 Enomoto ..... H01H 9/443 439/39
2013/0057369 A1 * 3/2013 Yano ..... H01H 1/66 335/156
2013/0234811 A1 * 9/2013 Nishimura ..... H01H 50/643 335/189
2014/0184366 A1 * 7/2014 Ito ..... H01H 50/54 335/189
2015/0077202 A1 * 3/2015 Enomoto ..... H01H 1/50 335/171
2016/0155592 A1 * 6/2016 Ito ..... H01H 50/36 335/187

FOREIGN PATENT DOCUMENTS

| | | |
|---|---|---|
| EP | 0080939 | 6/1983 |
| JP | 2003-100189 | 4/2003 |
| JP | 2010-10056 | 1/2010 |

OTHER PUBLICATIONS

Chinese Official action dated Aug. 15, 2014, along with an English-language translation thereof.

* cited by examiner

CONTACT APPARATUS

CROSS REFERENCE TO RELATED APPLICATION

This is a continuation application of pending U.S. application Ser. No. 13/809,961 filed on Jan. 14, 2013, which is a National Stage of International Application No. PCT/IB2011/000352 which was filed on Feb. 23, 2011, the disclosures of which are expressly incorporated herein by reference in their entireties.

FIELD OF THE INVENTION

The present invention relates to a contact apparatus.

BACKGROUND OF THE INVENTION

In the past, there is known a contact apparatus that includes, as shown in FIG. 18, fixed terminals 33 with fixed contacts 32, a movable contact member 71 with movable contacts 72, a yoke plate 81, a contact pressure spring 36, a movable shaft 91, a case 31, and a drive means 2 (see, e.g., Japanese Patent Application Publication No. 2010-010056).

The movable contact member 71 is formed into a substantially rectangular plate shape. The movable contacts 72 are arranged in the left and right end regions of the upper surface of the movable contact member 71. An insertion hole 71*a* is formed in the substantially central region of the movable contact member 71.

The yoke plate 81 is made of a magnetic material and formed into a rectangular plate shape. The yoke plate 81 is fixed to the movable contact member 71 with the upper surface of the yoke plate 81 kept in contact with the lower surface of the movable contact member 71. The yoke plate 81 has an insertion hole 81*a* formed in the substantially central area thereof.

The movable shaft 91 includes a rod-shaped shaft portion 911 movably inserted through the insertion hole 71*a* of the movable contact member 71 and the insertion hole 81*a* of the yoke plate 81 and a yoke contact portion 912 having a rectangular plate shape which is made of a magnetic material and fixed to the upper end of the shaft portion 911.

The yoke contact portion 912 is formed to have a thickness substantially equal to the thickness of the yoke plate 81. The yoke contact portion 912 faces the upper surface of the movable contact member 71 and restrains the movable contact member 71 from moving toward the fixed contacts 32. The yoke contact portion 912 faces the yoke plate 81 through the movable contact member 71.

The contact pressure spring 36 is formed of a coil spring. The shaft portion 911 of the movable shaft 91 extends through the bore of the contact pressure spring 36. The upper end of the contact pressure spring 36 makes contact with the lower surface of the yoke plate 81 and presses the movable contact member 71 toward the fixed contacts 32 through the yoke plate 81.

An electromagnet is used as the drive means 2. The lower end of the shaft portion 911 of the movable shaft 91 is connected to the electromagnet.

If the movable shaft 91 is moved upward by the drive means 2 and if the yoke contact portion 912 is moved toward the fixed contacts 32, the movable contact member 71 is released from the restraint of movement toward the fixed contacts 32. Then, the movable contact member 71 is moved toward the fixed contacts 32 by the biasing force of the contact pressure spring 36. The movable contacts 72 come into contact with the fixed contacts 32.

In the contact apparatus, if a large current such as a short-circuit current flows between the fixed contacts 32 and the movable contacts 72, a downward contact repulsion force acts against the movable contact member 71 under the influence of the magnetic fields generated around the movable contact member 71.

In the contact apparatus, however, if the movable contacts 72 make contact with the fixed contacts 32 and if an electric current flows through the movable contact member 71, a magnetic flux passing through the yoke contact portion 912 and the yoke plate 81 about the movable contact member 71 is formed around the movable contact member 71. As a consequence, a magnetic attraction force acts between the yoke contact portion 912 and the yoke plate 81. The contact repulsion force is suppressed by the magnetic attraction force, thereby preventing a reduction in the contact pressure between the fixed contacts 32 and the movable contacts 72.

In the prior art, however, a demand has existed for a contact apparatus capable of obtaining a large contact pressure while suppressing an increase in size.

SUMMARY OF THE INVENTION

In view of the above, the present invention provides a contact apparatus capable of obtaining a large contact pressure while suppressing an increase in size.

In accordance with one aspect of the present invention, there is provided a contact apparatus including a case accommodating therein fixed contacts and movable contacts and a driving unit configured to drive the movable contacts to come into contact or out of contact the fixed contacts, the contact apparatus, including: the case; fixed terminals having the fixed contacts arranged within the case; a movable contact member having the movable contacts provided on one surface thereof so as to come into contact or out of contact with the fixed contacts; a first yoke arranged on said one surface of the movable contact member within the case, one surface of the first yoke facing an inner surface of the case and the other surface thereof facing said one surface of the movable contact member; a second yoke arranged on the other surface of the movable contact member within the case, the second yoke having one surface facing the other surface of the first yoke through the movable contact member; a contact pressure spring configured to bias the movable contact member toward the fixed contacts; a restraining unit configured to restrain the movable contact member from moving toward the fixed contacts; a movable shaft connected to the restraining unit; and the drive unit configured to drive the movable shaft so that the movable contacts come into contact or out of contact with the fixed contacts, wherein the first yoke is larger in volume than the second yoke.

Preferably, the first yoke may be larger in thickness than the second yoke.

Preferably, the first yoke may have a thickness twice as large as the thickness of the second yoke.

Preferably, the first yoke may include a first enlarged width portion formed at one end of the first yoke in a third direction orthogonal to a first direction along which the movable contacts are arranged and orthogonal to a second direction as a thickness direction of the movable contact member, the first enlarged width portion having a width in the first direction growing larger toward said one end of the first yoke; and a second enlarged width portion formed at the other end of the first yoke, the second enlarged width portion having a width in the first direction growing larger toward the other end of the first yoke.

Preferably, the movable contact member may be configured such that, when energized, magnetic fluxes passing through the first yoke and the second yoke are generated around the movable contact member, the first yoke having first taper surfaces formed in magnetic-flux incoming and outgoing portions on the other surface of the first yoke, the second yoke having second taper surfaces formed on said one surface of the second yoke in an opposing relationship with the first taper surfaces, the second taper surfaces being parallel to the first taper surfaces.

Preferably, the other surface of the movable contact member may make contact with said one surface of the second yoke, one of the other surface of the movable contact member and said one surface of the second yoke having a first protrusion portion, the other of the other surface of the movable contact member and said one surface of the second yoke having a first recess portion to which the first protrusion portion is fitted.

Preferably, the second yoke may have a second protrusion portion formed on the other surface thereof, the contact pressure spring being formed of a coil spring, the second protrusion portion being fitted to one end of a bore of the contact pressure spring.

Preferably, the movable contact member may have an insertion hole, the movable shaft including a shaft portion movably inserted into the insertion hole and a contact portion provided at one end of the shaft portion to restrain the movable contact member from moving toward the fixed contacts.

Preferably, the contact apparatus may further include a holding member including a top plate, a bottom plate, and a pair of side plates configured to interconnect the top plate and the bottom plate, the holding member being formed into a substantially rectangular frame shape, the movable contact member being arranged between the side plates, said one surface of the first yoke making contact with the top plate of the holding member such that the first yoke is held by the holding member, one end of the contact pressure spring making contact with the other surface of the second yoke, the other end of the contact pressure spring making contact with the bottom plate of the holding member, the movable shaft being connected to the holding member.

Preferably, one of said one surface of the first yoke and the top plate of the holding member making contact with said one surface of the first yoke may have a third protrusion portion, and the other of said one surface of the first yoke and the top plate of the holding member has a third recess portion to which the third protrusion portion is fitted.

Preferably, the side plates may have cutouts formed to extend from an inner surface thereof in a thickness direction, the first yoke and the second yoke having side end portions arranged in the cutouts.

Preferably, the first yoke may have opposite end portions fitted to the cutouts.

Preferably, the second yoke may have opposite end portions making sliding contact with side edges of the cutouts.

Preferably, the first yoke may engage with the holding member.

With the present invention, it is possible to provide a contact apparatus capable of obtaining a large contact pressure while suppressing an increase in size.

DETAILED DESCRIPTION OF THE EMBODIMENTS

Embodiments of the present invention will now be described with reference to the drawings.

First Embodiment

A contact apparatus according to a first embodiment will be described with reference to FIGS. 1 through 6. In the following description, the up-down and left-right directions will be defined on the basis of the directions shown in FIG. 1. The direction orthogonal to the up-down and left-right directions will be defined as a front-rear direction.

Figure 1:
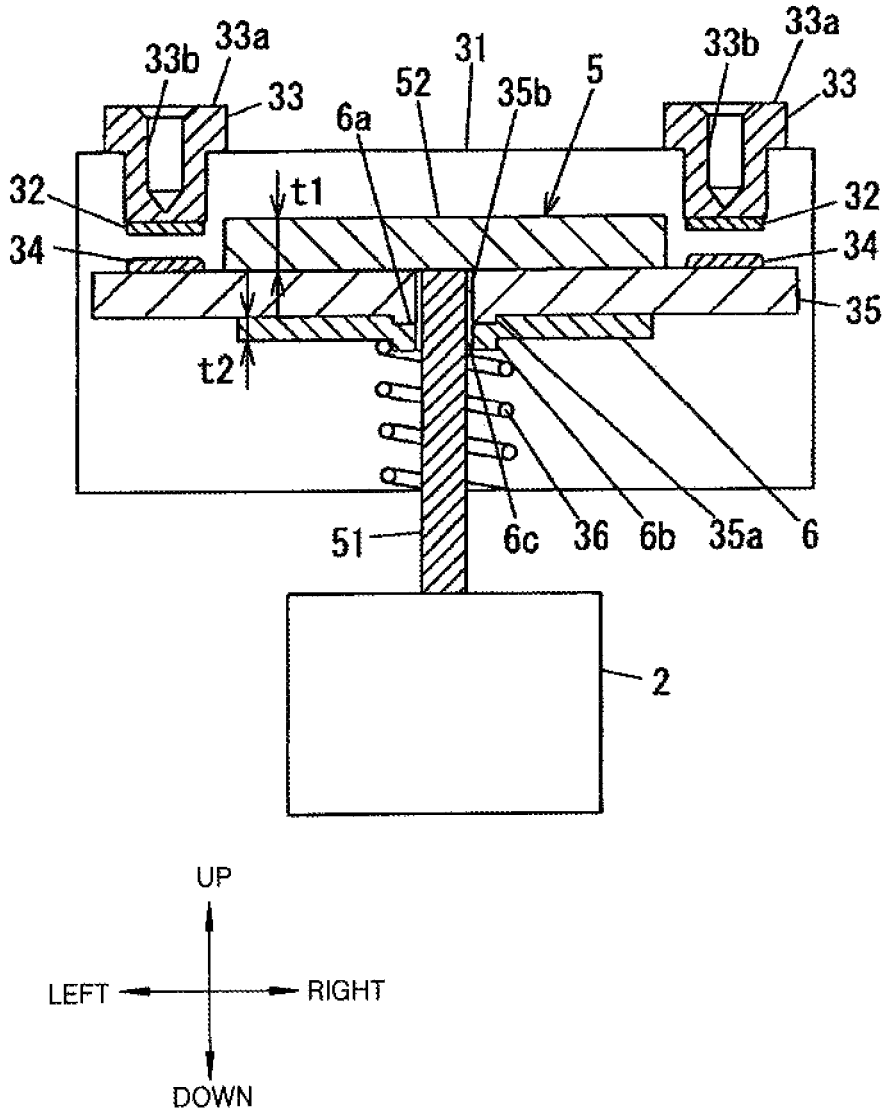
FIG. 1 is a section view showing a contact apparatus according to a first embodiment of the present invention.
Figure 2:
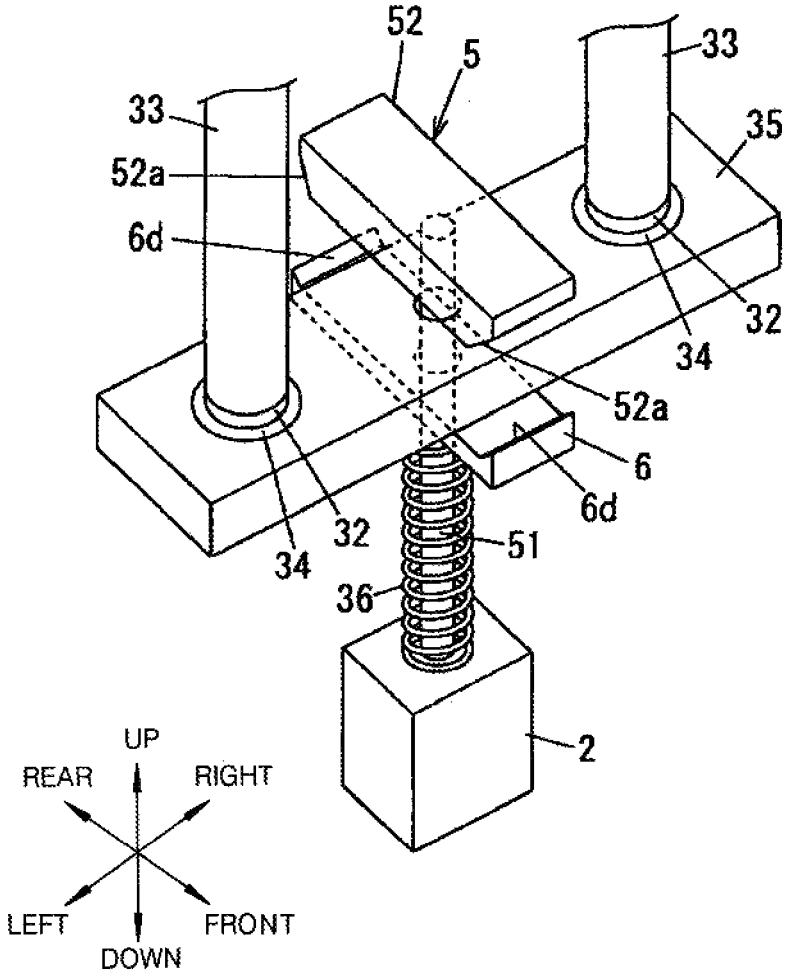
FIG. 2 is a perspective view of the contact apparatus according to the first embodiment.

As shown in FIGS. 1 and 2, the contact apparatus of the present embodiment includes a case 31, fixed terminals 33 with fixed contacts 32, a movable contact member 35 with movable contacts 34, a contact pressure spring 36, a movable shaft 5, a yoke plate 6 and an electromagnet block (drive means) 2.

The case 31 is made of a heat-resistant material such as ceramic or the like and is formed into a hollow rectangular box shape. A gas for rapidly extinguishing an arc generated when the fixed contacts 32 and the movable contacts 34 come into contact and out of contact with each other is filled into the case 31. As the gas, use is made of a gas superior in heat conductivity at a temperature region where the arc is generated, e.g., a mixed gas mainly composed of a hydrogen gas.

The fixed terminals 33 are made of an electrically conductive material such as a copper or the like and are formed into a substantially cylindrical columnar shape. The fixed terminals 33 are installed to extend through the upper surface of the case 31. Flanges 33*a* are formed at the upper ends of the fixed terminals 33. The fixed contacts 32 are fixedly secured to the lower ends of the fixed terminals 33. The fixed contacts 32 may be one-piece formed with the fixed terminals 33. Thread holes 33*b* are formed in the fixed terminals 33 to axially extend from the upper surfaces of the fixed terminals 33. An external load not shown is attached to the fixed terminals 33 by tightening screws not shown into the thread holes 33*b*.

The movable contact member 35 is formed into a substantially rectangular plate shape. The movable contacts 34 are fixedly secured to the left and right end regions of the upper surface of the movable contact member 35. A positioning protrusion portion (first protrusion portion) 35*a* having a substantially rectangular plate shape is formed on the substantially central region of the lower surface of the movable contact member 35. An insertion hole 35*b* extending substantially in a thickness direction is formed in the substantially central region of the movable contact member 35. The movable contact member 35 is arranged within the case 31 with the movable contacts 34 facing the fixed contacts 32.

The movable shaft 5 includes a rod-shaped shaft portion 51 and a yoke contact portion (a first yoke or a restraint means) 52 made of a magnetic material and on-piece formed with the shaft portion 51 at the upper end of the shaft portion 51.

The shaft portion 51 is formed into an elongated round rod shape and is movably inserted into the insertion hole 35*b* of the movable contact member 35 and the insertion hole 6*c* formed in the substantially central region of the yoke plate 6.

As shown in FIG. 2, the yoke contact portion (first yoke) 52 is made of a magnetic material and is formed into a rectangular plate shape to have a thickness t1. The yoke contact portion 52 is connected to the upper end of the shaft portion 51. The lower surface of the yoke contact portion 52 faces the upper surface of the movable contact member 35. The upper surface of the yoke contact portion 52 faces the upper surface of the case 31. The shaft portion 51 and the yoke contact portion 52 may be one-piece formed with each other.

As shown in FIG. 2, the front and rear corner sections of the lower surface of the yoke contact portion 52 are chamfered to form slant surfaces (first taper surfaces) 52*a*.

Figure 3:
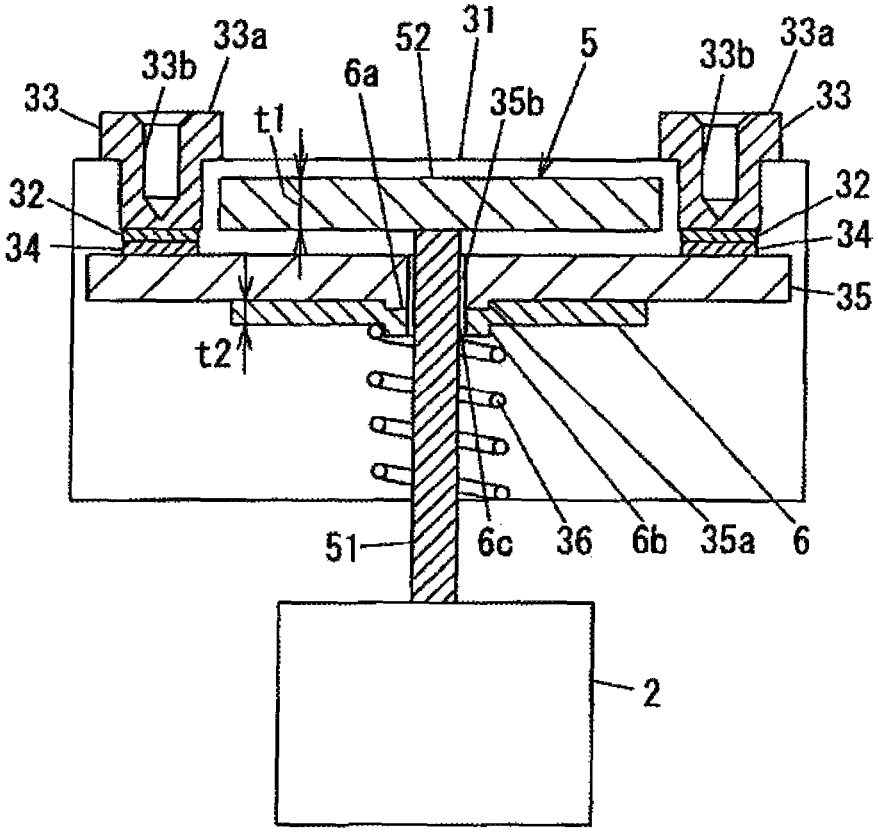
FIG. 3 is a section view of the contact apparatus according to the first embodiment.

Referring to FIG. 3, the yoke plate (second yoke) 6 is made of a magnetic material and is formed into a rectangular plate shape to have a thickness t2 (t2=t1/2) equal to one half of the thickness t1 of the yoke contact portion 52. A recess portion (first recess portion) 6*a* of substantially rectangular plate shape is formed in the substantially central region of the upper surface of the yoke plate 6. A protrusion portion (second protrusion portion) 6*b* of substantially circular plate shape is formed in the substantially central region of the lower surface of the yoke plate 6. As stated above, the insertion hole 6*c* extending in the thickness direction is formed in the substantially central region of the yoke plate 6.

Slant surfaces (second taper surfaces) 6*d* inclined upward toward the front and rear tip ends of the yoke plate 6 are formed at the front and rear ends of the upper surface of the yoke plate 6. In this regard, the slant surfaces 6*d* are formed to extend substantially parallel to the slant surfaces 52*a* of the yoke contact portion 52. The slant surfaces 6*d* face the slant surfaces 52*a* in the up-down direction.

In the yoke plate 6, the shaft portion 51 of the movable shaft 5 is movably inserted through the insertion hole 6*c*. The positioning protrusion portion 35*a* of the movable contact member 35 is fitted to the recess portion 6*a*. Thus the yoke plate 6 is positioned with respect to the movable contact member 35.

The contact pressure spring 36 is formed of a coil spring. The shaft portion 51 of the movable shaft 5 is moveably inserted through the bore of the contact pressure spring 36. The protrusion portion 6*b* of the yoke plate 6 is inserted into the upper end portion of the bore of the contact pressure spring 36, thereby positioning the contact pressure spring 36 with respect to the yoke plate 6. The lower end of the contact pressure spring 36 makes contact with the inner surface of the case 31. Thus the contact pressure spring 36 is kept compressed between the inner surface of the case 31 and the yoke plate 6, whereby the contact pressure spring 36 presses the movable contact member 35 toward the fixed contacts 32 (upward) through the yoke plate 6. At this time, the upper surface of the movable contact member 35 pressed upward makes contact with the yoke contact portion 52. Thus the movable contact member 35 is restrained from moving toward the fixed contacts 32.

The lower end of the shaft portion 51 of the movable shaft 5 is connected to the electromagnet block 2. When energized or de-energized, the electromagnet block 2 causes the movable shaft 5 to move upward. The contact apparatus of the present embodiment is a so-called normally-opened contact apparatus. This means that, when the electromagnet block 2 is energized, the movable contacts 34 come into contact with the fixed contacts 32. Description will now be made on the operation of the contact apparatus of the present embodiment.

If the electromagnet block 2 is energized, the movable shaft 5 is moved upward by the electromagnet block 2. The yoke contact portion 52 of the movable shaft 5 is displaced upward, thereby releasing the upward movement restraint of the movable contact member 35. Then, as shown in FIG. 3, the movable contact member 35 is displaced toward the fixed contacts 32 by the upward biasing force applied from the contact pressure spring 36 through the yoke plate 6. The movable contacts 34 and the fixed contacts 32 make contact with each other, whereby the movable contacts 34 and the fixed contacts 32 are electrically connected to each other. At this time, the yoke contact portion 52 is maintained in the post-displacement position by the electromagnet block 2. Accordingly, the yoke contact portion 52 makes contact with or adjoins the movable contact member 35 moved upward by the contact pressure spring 36.

If the movable contacts 34 and the fixed contacts 32 are electrically connected to each other and if an electric current flows through the movable contact member 35, magnetic fields are generated around the movable contact member 35. The yoke contact portion 52 and the yoke plate 6 are magnetized and are attracted toward each other. In other words, a magnetic attraction force is generated between the yoke contact portion 52 and the yoke plate 6. At this time, the movable shaft 5 is kept in position by the electromagnet block 2. Therefore, the position of the yoke contact portion 52 is maintained and the yoke plate 6 receives a magnetic attraction force from the yoke contact portion 52, thereby pressing the movable contact member 35 toward the fixed contacts 32. The magnetic attraction force acts in the substantially 180 degree opposite direction with respect to the contact repulsion force (downward force) generated in the movable contact member 35 when the movable contacts 34 and the fixed contacts 32 make contact with each other or when a large current such as a short-circuit current flows through the movable contact member 35. Accordingly, the magnetic attraction force acting between the yoke contact portion 52 and the yoke plate 6 acts in the direction in which the contact repulsion force is removed in the most efficient manner.

Figure 4:
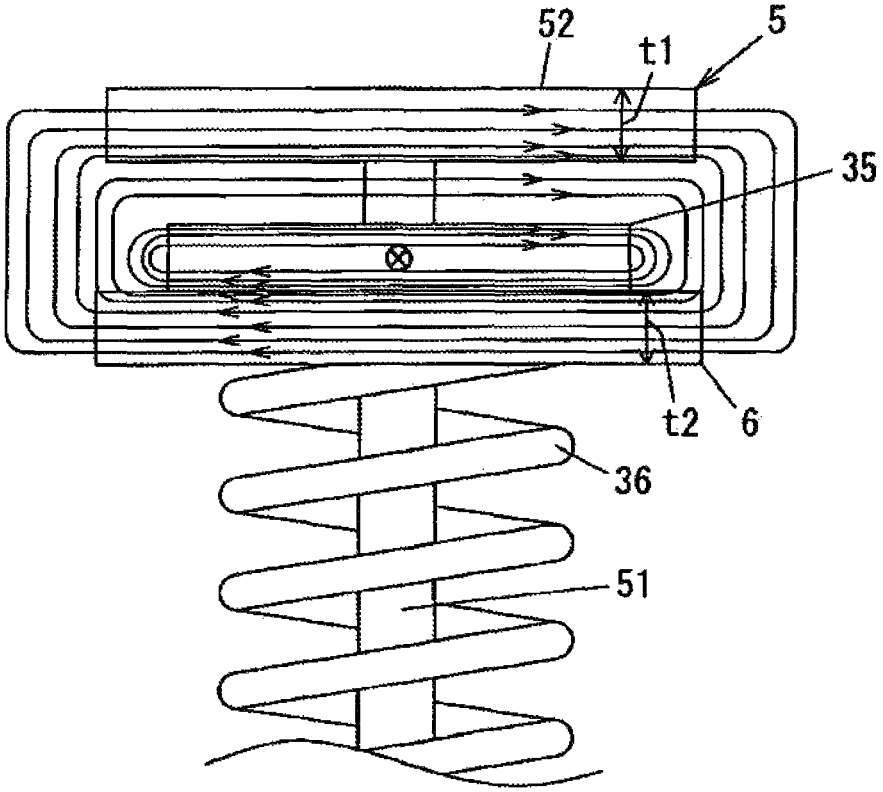
FIG. 4 is a schematic view showing certain major portions of a contact apparatus according to a prior art example.

For example, if the thickness t1 of the yoke contact portion 52 is set equal to the thickness t2 of the yoke plate 6 (if t1=t2) as shown in FIG. 4, the number of magnetic fluxes moving from the right side toward the left side through the movable contact member 35 becomes substantially equal to the number of magnetic fluxes moving from the left side toward the right side through the movable contact member 35. For that reason, the movable contact member 35 is not magnetized. No magnetic attraction force acts between the movable contact member 35 and the yoke contact portion 52. No electromagnetic force attributable to the magnetic fluxes is generated in the movable contact member 35.

Figure 5:
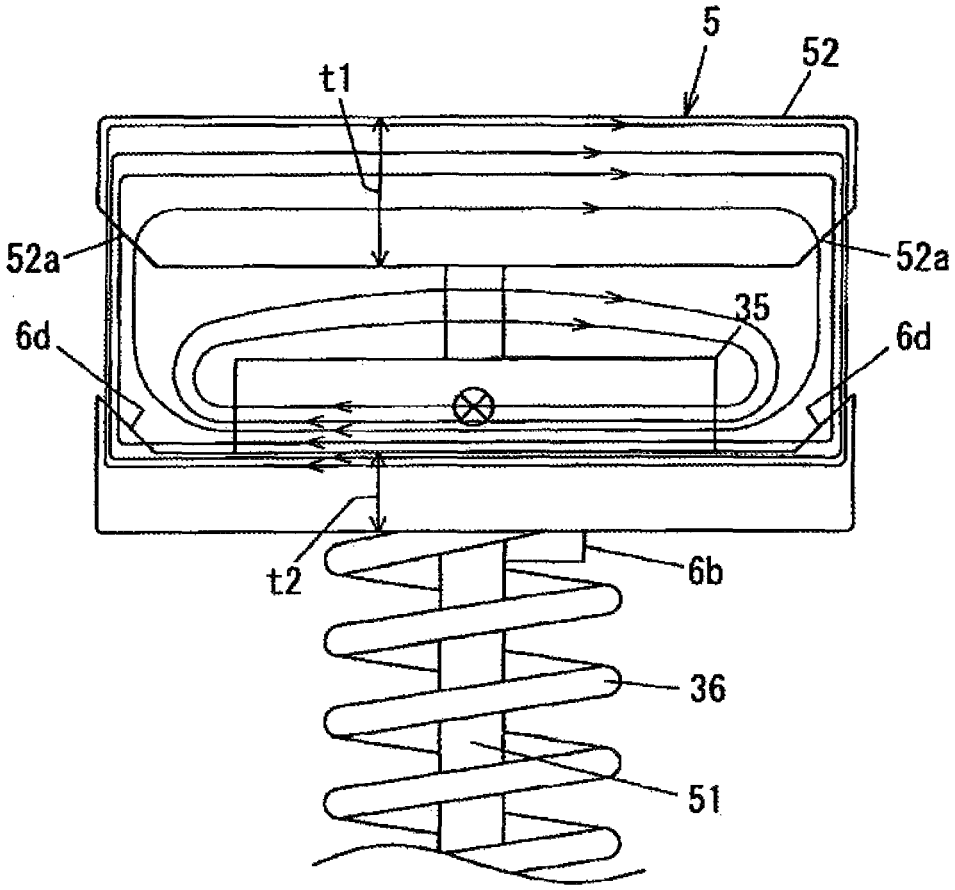
FIG. 5 is a schematic view showing certain major portions of the contact apparatus according to the first embodiment.

However, if the thickness t1 of the yoke contact portion 52 is increased (if t1>t2), the balance of the magnetic fields generated around the movable contact member 35 is destroyed under the influence of the yoke contact portion 52 as shown in FIG. 5. More specifically, the magnetic fluxes moving from the left side toward the right side are attracted toward the yoke contact portion 52, as a result of which the ratio of the magnetic fluxes passing through the movable contact member 35 is reduced. On the other hand, the magnetic fluxes moving from the right side toward the left side in FIG. 5 are attracted upward, as a result of which the ratio of the magnetic fluxes passing through the movable contact member 35 is increased. In other words, the number of magnetic fluxes moving from the right side toward the left side through the movable contact member 35 in FIG. 5 becomes larger than the number of magnetic fluxes moving from the left side toward the right side through the movable contact member 35. In this regard, if an electric current flows through the movable contact member 35 from the front surface side of the paper sheet toward the rear surface side thereof in FIG. 5, the magnetic fluxes moving from the right side toward the left side through the movable contact member 35 apply an upward electromagnetic force to the movable contact member 35. The magnetic fluxes moving from the left side toward the right side through the movable contact member 35 apply a downward electromagnetic force to the movable contact member 35. For that reason, the upward electromagnetic force (Lorentz force) which is larger than the downward electromagnetic force is applied to the movable contact member 35.

Accordingly, two kinds of upward forces, i.e., the upward electromagnetic force and the upward magnetic attraction force received from the yoke plate 6, are applied to the movable contact member 35.

Figure 6:
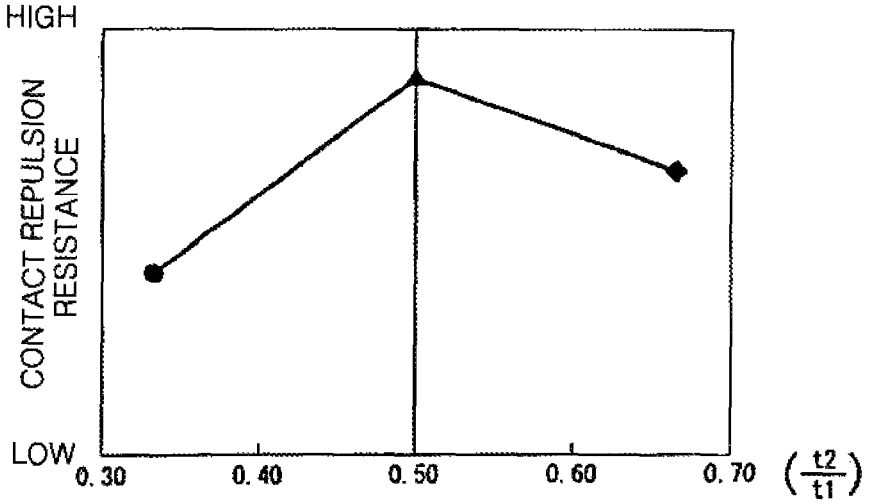
FIG. 6 shows a change in the contact repulsion resistance with respect to the thickness ratio of a yoke contact portion and a yoke plate of the contact apparatus according to the first embodiment.

FIG. 6 shows a change in the contact repulsion resistance (the sum of three upward and downward forces acting on the movable contact member 35) when the thickness t2 of the yoke contact portion 52 is changed. As shown in FIG. 6, if the thickness t1 of the yoke contact portion 52 is gradually increased with respect to the thickness t2 of the yoke plate 6, the contact repulsion resistance grows larger in proportion to the increase of the thickness t1 and becomes largest when t2/t1 is equal to 0.5. In other words, the contact repulsion resistance becomes largest when t1:t2 is 2:1.

If the thickness t1 of the yoke contact portion 52 is further increased (if t2/t1<0.5), the electromagnetic force acting on the movable contact member 35 gets saturated. On the other hand, the magnetic fluxes passing through the yoke plate 6 is reduced and the magnetic attraction force acting between the yoke plate 6 and the yoke contact portion 52 is reduced. Accordingly, the contact repulsion resistance is reduced.

In other words, the contact apparatus of the present embodiment, in which the ratio of the thickness t1 of the yoke contact portion 52 to the thickness t2 of the yoke plate 6 (t1:t2) is set equal to 2:1, is capable of obtaining a large contact pressure while suppressing an increase in size.

In the contact apparatus of the present embodiment, the slant surfaces 52*a* are formed at the front and rear ends of the lower surface of the yoke contact portion 52. The slant surfaces 6*d* facing the slant surfaces 52*a* and remaining parallel to the slant surfaces 52*a* are formed at the front and rear ends of the upper surface of the yoke plate 6. For that reason, the mutually facing area of the yoke contact portion 52 and the yoke plate 6 grows larger and the magnetic attraction force acts more strongly. It is therefore possible to increase the contact repulsion resistance.

Second Embodiment

A contact apparatus according to a second embodiment will now be described with reference to FIGS. 7 through 9. In the following description, the up-down and left-right directions will be defined on the basis of the directions shown in FIG. 7. The direction orthogonal to the up-down and left-right directions will be defined as a front-rear direction. The same configurations as those of the first embodiment will be designated by like reference symbols and will not be described in detail.

Figure 7:
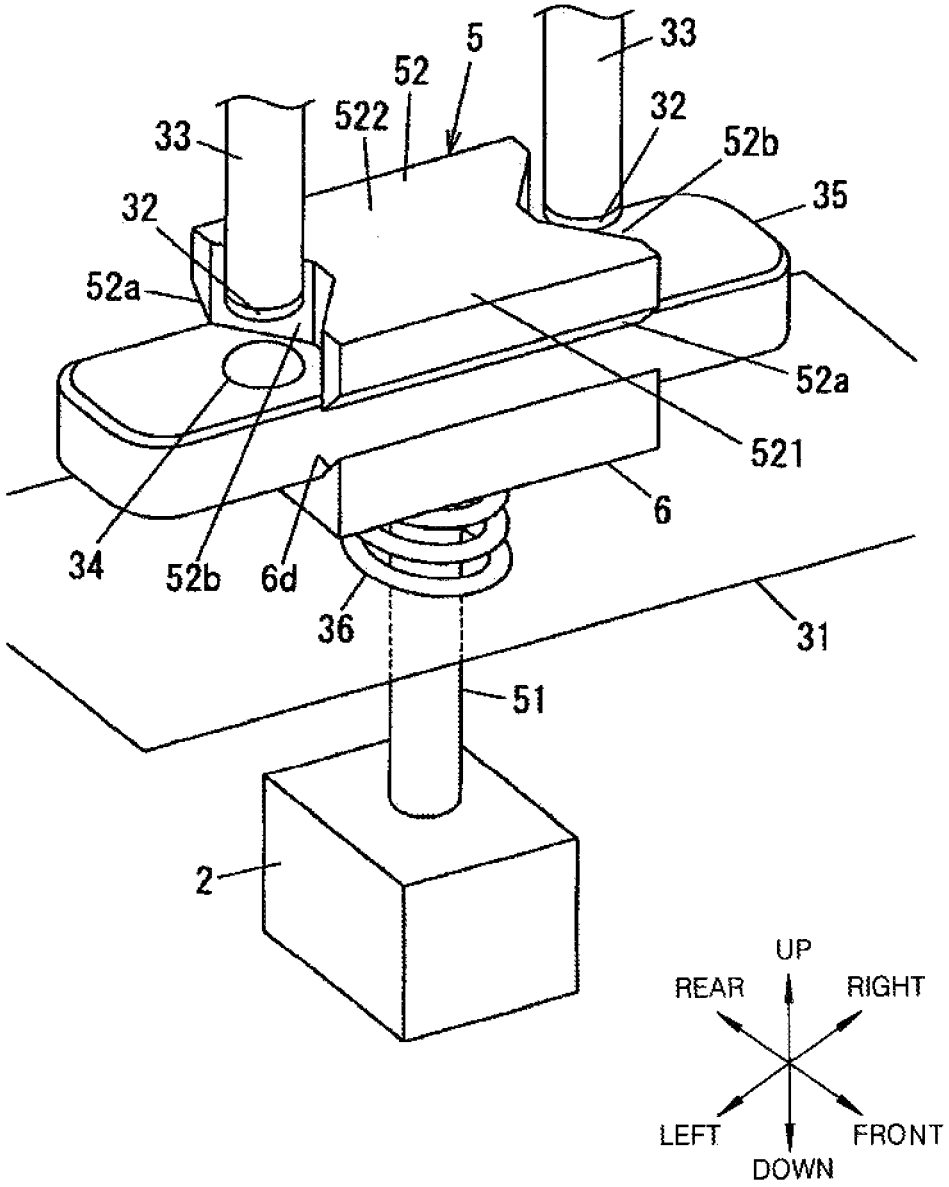
FIG. 7 is a perspective view showing a contact apparatus according to a second embodiment of the present invention.

In FIG. 7, only the lower surface of the case 31 is illustrated and other surfaces of the case 31 are omitted.

Figure 8A:
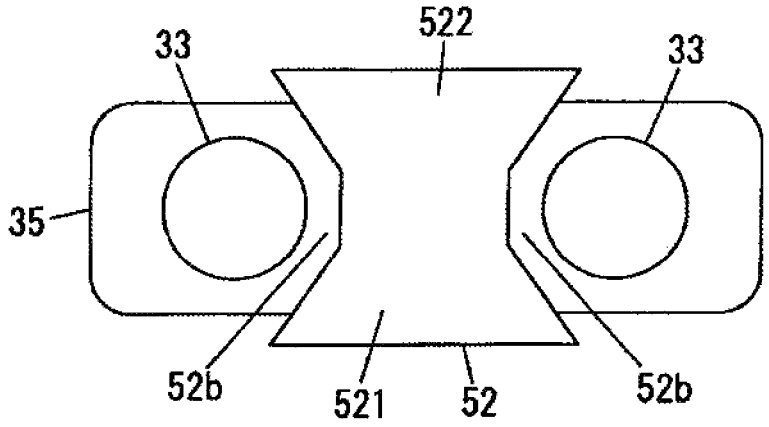
FIG. 8A is a schematic view showing the contact apparatus according to the second embodiment provided with a yoke contact portion of substantially double-headed drum shape and FIG. 8B is a schematic view showing another example of the contact apparatus provided with a yoke contact portion of substantially rectangular shape.
Figure 8B:
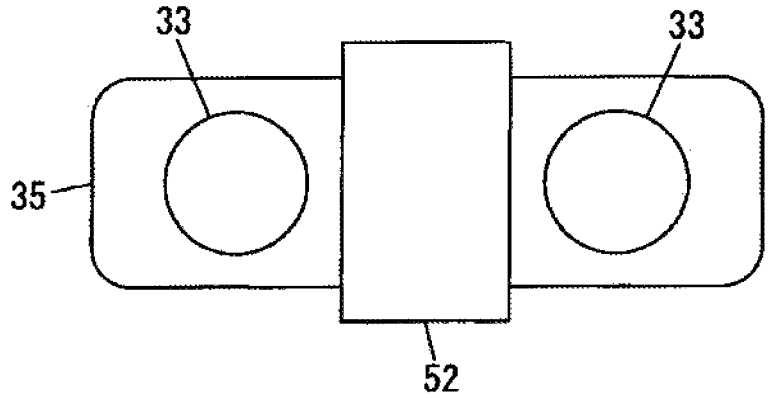
Figure 9:
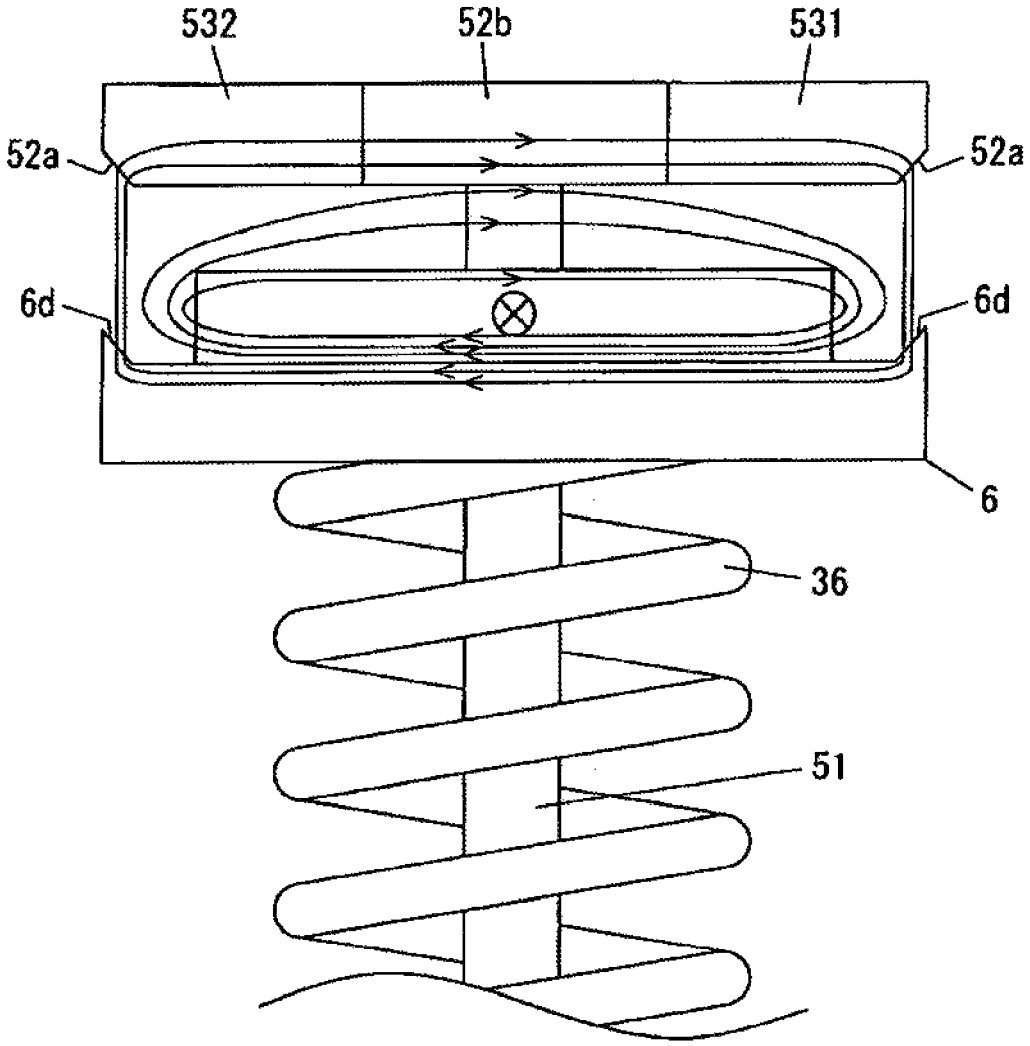
FIG. 9 is a schematic view showing certain major portions of the contact apparatus according to the second embodiment.

As shown in FIGS. 7 and 8A, the yoke contact portion (first yoke) 52 is arranged between the movable contacts 34 on the upper surface of the movable contact member 35 in an opposing relationship with the movable contact member 35. Cutouts 52*b* having a substantially trapezoidal shape are formed at the left and right ends of the yoke contact portion 52 so as to avoid interference with the fixed terminals 33. More specifically, the yoke contact portion 52 includes enlarged width sections (a first enlarged width section 521 and a second enlarged width section 522) whose left-right width grows larger from the front-rear center toward the front side and the rear side. The yoke contact portion 52 is made of a magnetic material and is formed into a substantially double-headed drum shape. When the shaft portion 51 is moved in the axial direction, the fixed terminals 33 enter the cutouts 52*b*, thereby preventing the yoke contact portion 52 from interfering with the fixed terminals 33. Therefore, as compared with a case where the yoke contact portion 52 is formed into a rectangular shape as shown in FIG. 8B, it is possible to increase the volume of the yoke contact portion 52. The shaft portion 51 and the yoke contact portion 52 may be one-piece formed with each other.

In the contact apparatus of the present embodiment, the yoke contact portion 52 is formed into a substantially double-headed drum shape as shown in FIG. 8A. Thus the volume of the yoke contact portion 52 is larger than when the yoke contact portion 52 is formed into a substantially rectangular shape. For that reason, as shown in FIG. 9, the balance of the magnetic fields generated around the movable contact member 35 is collapsed under the influence of the yoke contact portion 52. The magnetic fluxes moving from the left side toward the right side are attracted toward the yoke contact portion 52, as a result of which the ratio of the magnetic fluxes passing through the movable contact member 35 is reduced. On the other hand, the magnetic fluxes moving from the right side toward the left side in FIG. 9 are attracted upward, as a result of which the ratio of the magnetic fluxes passing through the movable contact member 35 is increased. In other words, the number of magnetic fluxes moving from the right side toward the left side through the movable contact member 35 in FIG. 9 becomes larger than the number of magnetic fluxes moving from the left side toward the right side through the movable contact member 35. In this regard, if an electric current flows through the movable contact member 35 from the front surface side of the paper sheet toward the rear surface side thereof in FIG. 9, the magnetic fluxes moving from the right side toward the left side through the movable contact member 35 apply an upward electromagnetic force to the movable contact member 35. The magnetic fluxes moving from the left side toward the right side through the movable contact member 35 apply a downward electromagnetic force to the movable contact member 35. For that reason, the upward electromagnetic force (Lorentz force) which is larger than the downward electromagnetic force is applied to the movable contact member 35.

Accordingly, two kinds of upward forces, i.e., the upward magnetic attraction force received from the yoke plate 6 and the upward electromagnetic force, are applied to the movable contact member 35. Since the yoke contact portion 52 is formed into a substantially double-headed drum shape as described above, it is possible to increase the volume of the yoke contact portion 52 while preventing the yoke contact portion 52 from interfering with the fixed terminals 33. It is also possible to apply not only the upward magnetic attraction force but also the upward electromagnetic force to the movable contact member 35. Since the volume of the yoke contact portion 52 can be increased and the electromagnetic force can be generated without having to increase the thickness of the yoke contact portion 52, it is possible to prevent the contact apparatus from becoming larger in the up-down size. Accordingly, the contact apparatus of the present embodiment is capable of obtaining a large contact pressure while suppressing an increase in size.

Third Embodiment

Figure 10B:
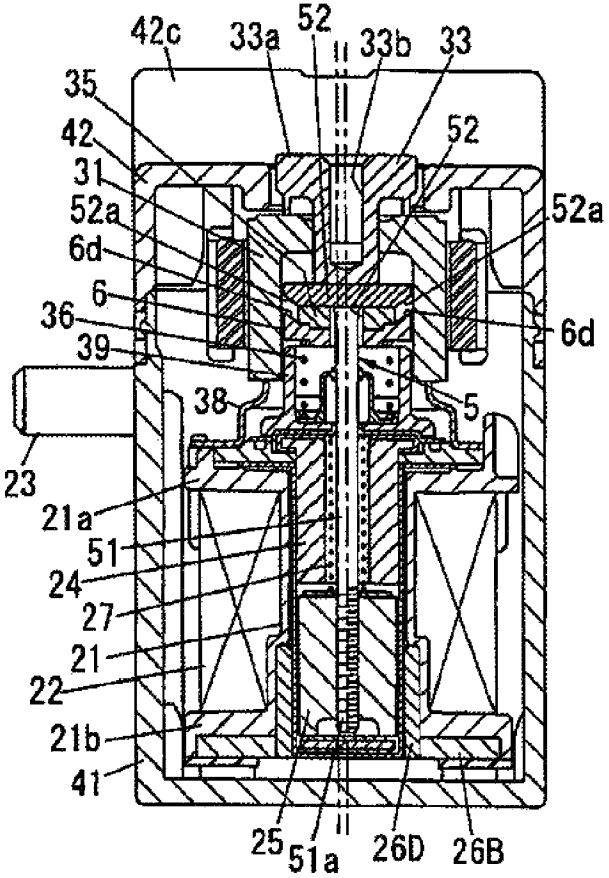
FIGS. 10A and 10B are section views showing an electromagnetic relay according to a third embodiment of the present invention provided with the contact apparatus.

A contact apparatus according to a third embodiment is used in, e.g., an electromagnetic relay shown in FIG. 10.

As shown in FIGS. 10A, 10B, 11A, 11B and 12A through 12C, the electromagnetic relay includes a hollow box-shaped housing 4. An internal block 1 formed by combining an electromagnet block (drive means) 2 and a contact block 3 is arranged within the housing 4. In the following description, the up-down and left-right directions will be defined on the basis of the directions shown in FIG. 10A. The direction orthogonal to the up-down and left-right directions will be defined as a front-rear direction.

The electromagnet block 2 includes a coil bobbin 21 around which an exciting coil 22 is wound, a pair of coil terminals 23 to which the opposite ends of the exciting coil 22 are connected, a fixed iron core 24 arranged within and fixed to the coil bobbin 21, a movable iron core 25, a yoke 26, and a return spring 27.

The coil bobbin 21 is made of a resin material and is formed into a substantially cylindrical shape to have flanges 21*a* and 21*b* formed at the upper and lower ends thereof. The exciting coil 22 is wound around a cylinder portion 21*c* existing between the flanges 21*a* and 21*b*. The lower extension of the cylinder portion 21*c* is larger in inner diameter than the upper extension of the cylinder portion 21*c*.

Figure 12A:
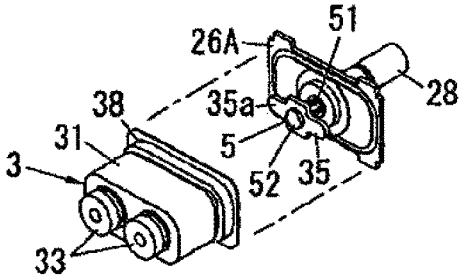
FIGS. 12A, 12B and 12C are exploded perspective view of the electromagnetic relay according to the third embodiment.
Figure 12B:
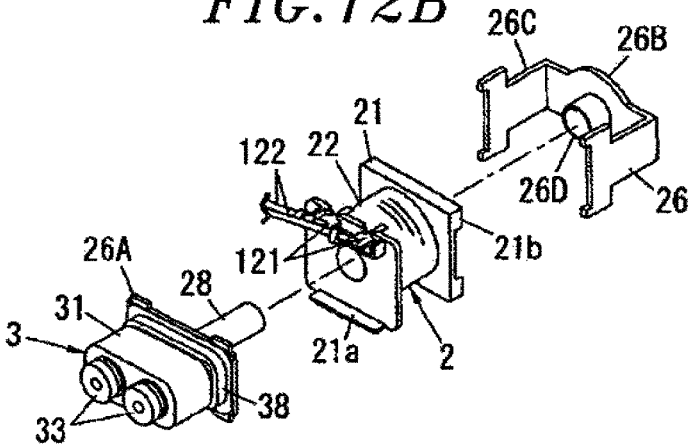
Figure 12C:
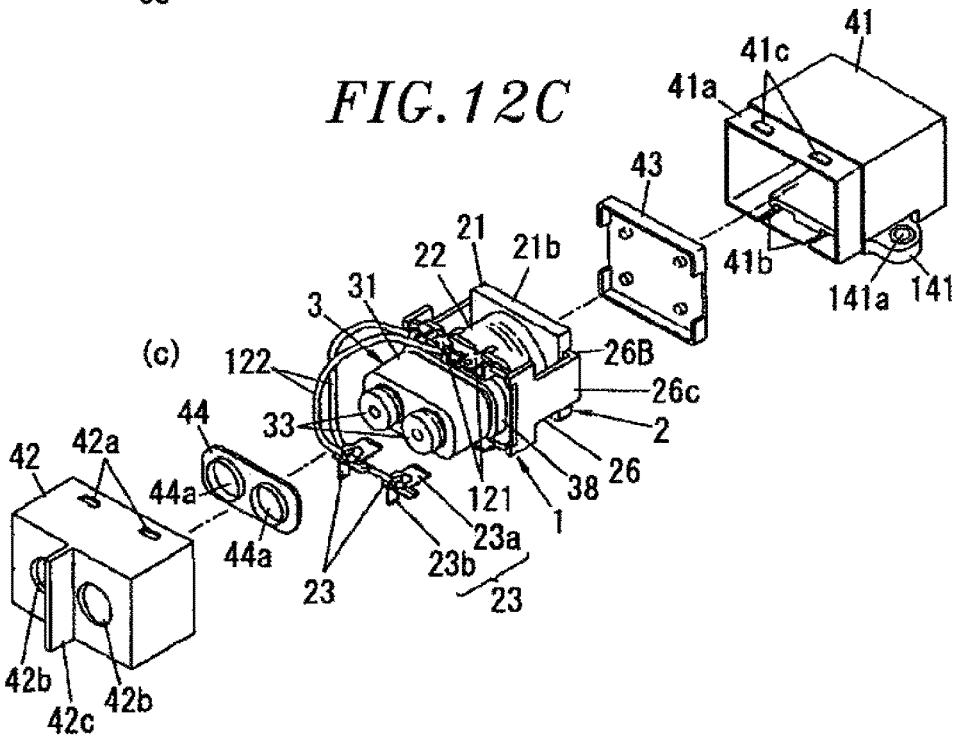

As shown in FIG. 12C, the end portions of the exciting coil 22 are connected to a pair of terminal portions 121 provided in the flange 21*a* of the coil bobbin 21. The terminal portions 121 are connected to the coil terminals 23 through lead wires 122.

The coil terminals 23 are made of an electrically conductive material such as copper or the like and are connected to the lead wires 122 by solders or the like.

Figure 10A:
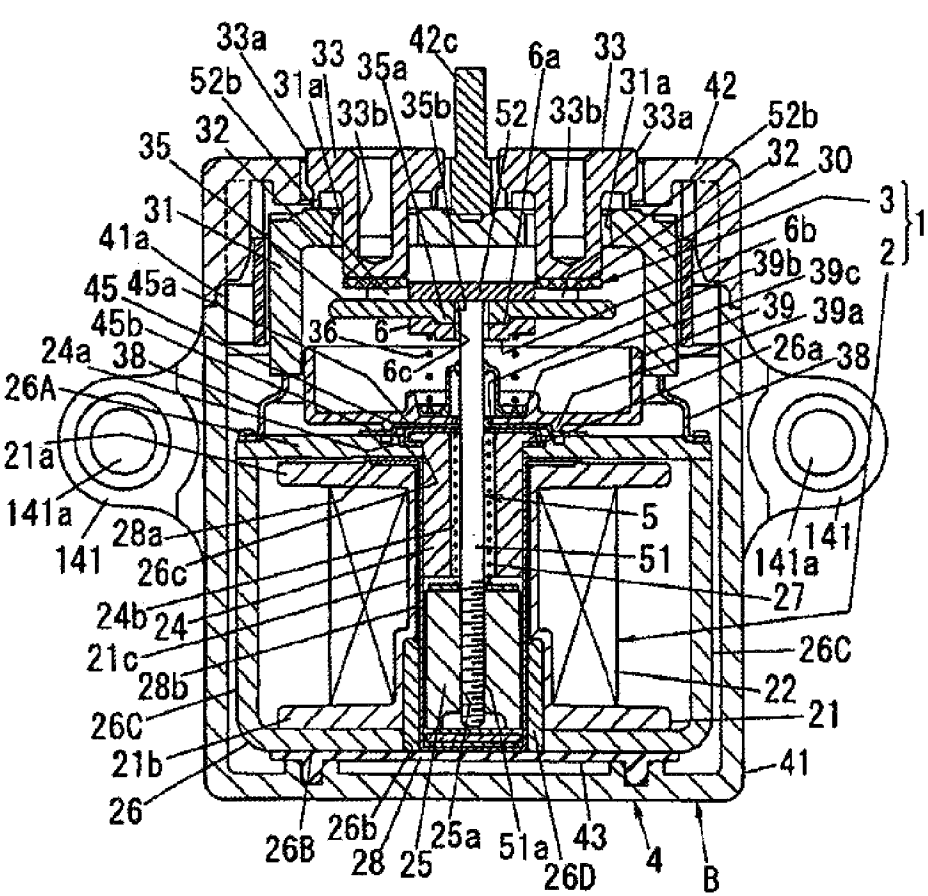
Figure 11B:
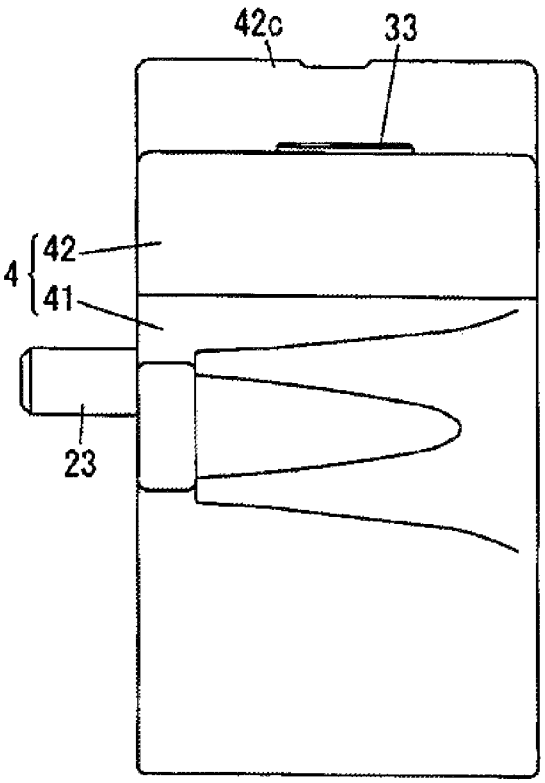
FIGS. 11A and 11B are external appearance views of the electromagnetic relay according to the third embodiment.
Figure 11A:
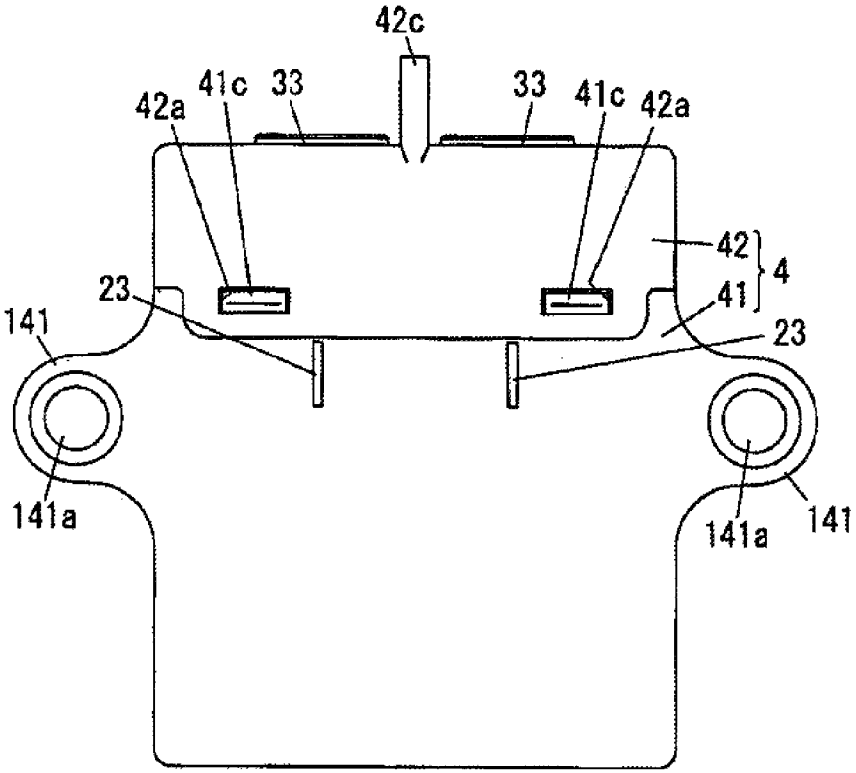

As shown in FIG. 10A, the yoke 26 includes a yoke plate 26A arranged near the upper end of the coil bobbin 21, a yoke plate 26B arranged near the lower end of the coil bobbin 21, and a pair of yoke plates 26C extending from the left and right ends of the yoke plate 26B toward the yoke plate 26A.

The yoke plate 26A is formed into a substantially rectangular plate shape. A recess portion 26*a* is formed in the substantially central region of the upper surface of the yoke plate 26A. An insertion hole 26*c* is formed in the substantially central region of the recess portion 26*a*.

A closed-bottom cylinder member 28 having a flange 28*a* formed at the upper end thereof is inserted into the insertion hole 26*c*. The flange 28*a* is joined to the recess portion 26*a*. The movable iron core 25 made of a magnetic material and formed into a cylindrical columnar shape is arranged in the lower end space within a cylinder portion 28*b* of the cylinder member 28. The fixed iron core 24 made of a magnetic material and formed into a substantially cylindrical shape is arranged within the cylinder portion 28*b* in an axially opposing relationship with the movable iron core 25.

A substantially disc-shaped cap member 45 having a peripheral edge portion fixed to the open edge of the insertion hole 26*c* of the yoke plate 26A is arranged on the upper surface of the yoke plate 26A. Removal of the movable iron core 25 is prevented by the cap member 45. The substantially central region of the cap member 45 is depressed upward in a substantially cylindrical columnar shape to form a recess portion 45*a*. The flange 24*a* formed at the upper end of the fixed iron core 24 is arranged within the recess portion 45*a*.

A cylindrical bush 26D made of a magnetic material is fitted to a gap between the lower inner circumferential surface of the coil bobbin 21 and the outer circumferential surface of the cylinder member 28. The bush 26D makes up a magnetic circuit in cooperation with the yoke plates 26A through 26C, the fixed iron core 24 and the movable iron core 25.

The return spring 27 is inserted through the bore 24*b* of the fixed iron core 24. The lower end of the return spring 27 makes contact with the upper surface of the movable iron core 25. The upper end of the return spring 27 makes contact with the lower surface of the cap member 45. The return spring 27 is arranged between the movable iron core 25 and the cap member 45 in a compressed state to resiliently bias the movable iron core 25 downward.

The contact block 3 includes a case 31, a pair of fixed terminals 33, a movable contact member 35, a yoke plate 6, a contact pressure spring 36, and a movable shaft 5.

The movable shaft 5 has a shaft portion 51 inserted through the insertion hole 35*b* formed in the substantially central region of the movable contact member 35, the insertion hole 6*c* formed in the substantially central region of the yoke plate 6, the insertion hole 45*b* formed in the substantially central region of the cap member 45, and the return spring 27. The shaft portion 51 has a thread section 51*a* formed in the lower end extension thereof. The thread section 51*a* is threadedly coupled to a thread hole 25*a* axially formed in the movable iron core 25. Thus the shaft portion 51 is connected to the movable iron core 25.

The case 31 is made of a heat-resistant material such as ceramic or the like and is formed into a hollow box-like shape to have an open lower surface. Two through-holes 31*a*, into which the fixed terminals 33 are inserted, are formed side by side on the upper surface of the case 31. The fixed terminals 33 are inserted into the through-holes 31*a* with the flanges 33*a* thereof protruding from the upper surface of the case 31 and are joined to the case 31 by soldering.

As shown in FIG. 10A, one end of a flange 38 is soldered to the peripheral edge of the opening of the case 31. The other end of the flange 38 is soldered to the yoke plate 26A.

In the opening of the case 31, there is provided an insulating member 39 by which the arcs generated between the fixed contacts 32 and the movable contacts 34 are insulated from the joint portion of the case 31 and the flange 38.

The insulating member 39 is formed into a substantially hollow rectangular parallelepiped shape by an insulating material such as ceramic or synthetic resin so as to have an opening formed on the upper surface thereof. The raised portion 45*a* of the cap member 45 is fitted to the recess portion existing inside a rectangular frame 39*a* formed in the substantially central region of the lower surface of the insulating member 39. The upper end extension of the peripheral wall of the insulating member 39 makes contact with the inner surface of the peripheral wall of the case 31, whereby the joint portion of the case 31 and the flange 38 is insulated from the contact unit including the fixed contacts 32 and the movable contacts 34.

An annular wall portion 39*c* having an inner diameter substantially equal to the outer diameter of the contact pressure spring 36 is formed in the substantially central region of the inner bottom surface of the insulating member 39. An insertion hole 39*b*, through which the movable shaft 5 is inserted, is formed in the substantially central region of the wall portion 39*c*. The lower end portion of the contact pressure spring 36 is fitted into the wall portion 39*c*, whereby the contact pressure spring 36 is prevented from being out of alignment.

The housing 4 is formed into a substantially rectangular box-like shape by a resin material. The housing includes a hollow box-like housing body 41 having an opening formed on the upper surface thereof and a hollow box-like cover 42 covering the opening of the housing body 41.

Ear portions 141 having insertion holes 141*a* used in threadedly fixing the electromagnetic relay to an installation surface are provided at the front ends of the left and right side walls of the housing body 41. A shoulder portion 41*a* is formed in the peripheral edge of the upper end opening of the housing body 41. Thus the outer circumference of the upper end portion of the housing body 41 is smaller than the outer circumference of the lower end portion of the housing body 41. A pair of slits 41*b*, into which the terminal portions 23*b* of the coil terminals 23 are fitted, are formed on the upper front surface of the housing body 41 positioned higher than the shoulder portion 41*a*. On the upper rear surface of the housing body 41 positioned higher than the shoulder portion 41*a*, a pair of recess portions 41*c* is formed side by side along the left-right direction.

The cover 42 is formed into a hollow box-like shape so as to have an opening on the lower surface thereof. A pair of protrusion portions 42*a* fitted into the recess portions 41*c* of the housing body 41 when the cover 42 is fixed to the housing body 41 is formed on the rear surface of the cover 42. A partition portion 42*c* substantially bisecting the upper surface of the cover 42 into left and right regions is formed on the upper surface of the cover 42. A pair of insertion holes 42*b*, into which the fixed terminals 33 are inserted, is formed on the upper surface of the cover 42 bisected by the partition portion 42*c*.

As shown in FIG. 12C, when the internal block 1 including the electromagnet block 2 and the contact block 3 is arranged within the housing 4, a lower cushion rubber 43 having a substantially rectangular shape is interposed between the lower end flange 21*b* of the coil bobbin 21 and the bottom surface of the housing body 41. Moreover, an upper cushion rubber 44 having insertion holes 44*a* into which the flanges 33*a* of the fixed terminals 33 are inserted is interposed between the case 31 and the cover 42.

In the electromagnetic relay configured as above, the return spring 27 is larger in spring modulus than the contact pressure spring 36. Therefore, the movable iron core 25 is slid downward by the pressing force of the return spring 27, in response to which the movable shaft 5 is also moved downward. As a result, the movable contact member 35 is pressed downward by the yoke contact portion 52 and is moved downward together with the yoke contact portion 52. In the initial state, therefore, the movable contacts 34 are kept spaced apart from the fixed contacts 32.

If the exciting coil 22 is energized, the movable iron core 25 is attracted by the fixed iron core 24 and is slid upward. In response, the movable shaft 5 connected to the movable iron core 25 is also moved upward. As a consequence, the yoke contact portion 52 of the movable shaft 5 is moved toward the fixed contacts 32, thereby releasing the upward movement restraint on the movable contact member 35. Then, the movable contact member 35 is moved toward the fixed contacts 32 by the pressing force of the contact pressure spring 36. Thus the movable contacts 34 make contact with the fixed contacts 32, whereby the movable contacts 34 and the fixed contacts 32 are electrically connected to each other.

If the exciting coil 22 is de-energized, the movable iron core 25 is slid downward by the pressing force of the return spring 27. In response, the movable shaft 5 is also moved downward. Consequently, the yoke contact portion 52 is moved downward and the movable contact member 35 is moved downward. Thus the fixed contacts 32 and the movable contacts 34 are spaced apart from each other and are electrically disconnected from each other.

Since the electromagnetic relay is provided with the contact apparatus of the second embodiment, it is possible to obtain a large contact pressure while suppressing an increase in size. It will be apparent to those skilled in the art that the electromagnetic relay may be provided with the contact apparatus of the first embodiment instead of the contact apparatus of the second embodiment. No detailed description will be made on the electromagnetic relay provided with the contact apparatus of the first embodiment.

Fourth Embodiment

A contact apparatus according to a fourth embodiment will now be described with reference to FIGS. 13 through 17. In the following description, the up-down and left-right directions will be defined on the basis of the directions shown in FIG. 13. The direction orthogonal to the up-down and left-right directions will be defined as a front-rear direction. The same configurations as those of the second embodiment will be designated by like reference symbols and will not be described in detail.

The contact apparatus of the present embodiment includes a case 31, fixed terminals 33 with fixed contacts 32, a movable contact member 35 with movable contacts 34, yoke plates (a first yoke and a second yoke) 63 and 64, a contact pressure spring 36, a holding member 65, a movable shaft 66, and an electromagnet block 2.

Figure 13:
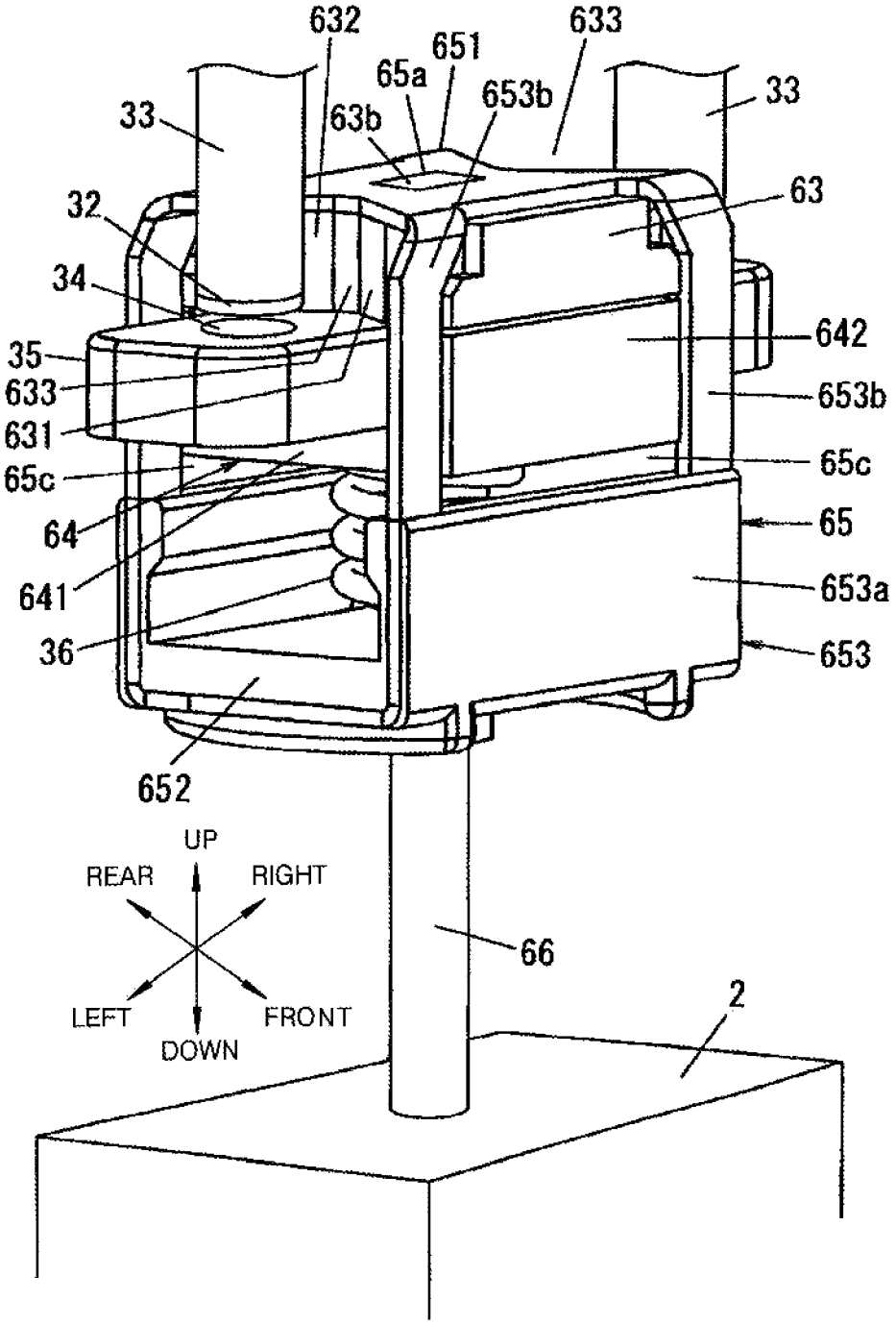
FIG. 13 is a perspective view showing a contact apparatus according to a fourth embodiment of the present invention.

As shown in FIG. 13, the yoke plate (first yoke) 63 is formed into a substantially double-headed drum shape to have enlarged width sections 631 and 632 whose left-right width grows larger from the substantially central region toward the front and rear tip ends. The yoke plate 63 is made of a magnetic material such as soft iron or the like. The yoke plate 63 is arranged between the movable contacts 34 in an opposing relationship with the upper surface of the movable contact member 35. The fixed terminals 33 are inserted into substantially trapezoidal cutouts 633 formed at the left and right ends of the yoke plate 63.

Figure 15:
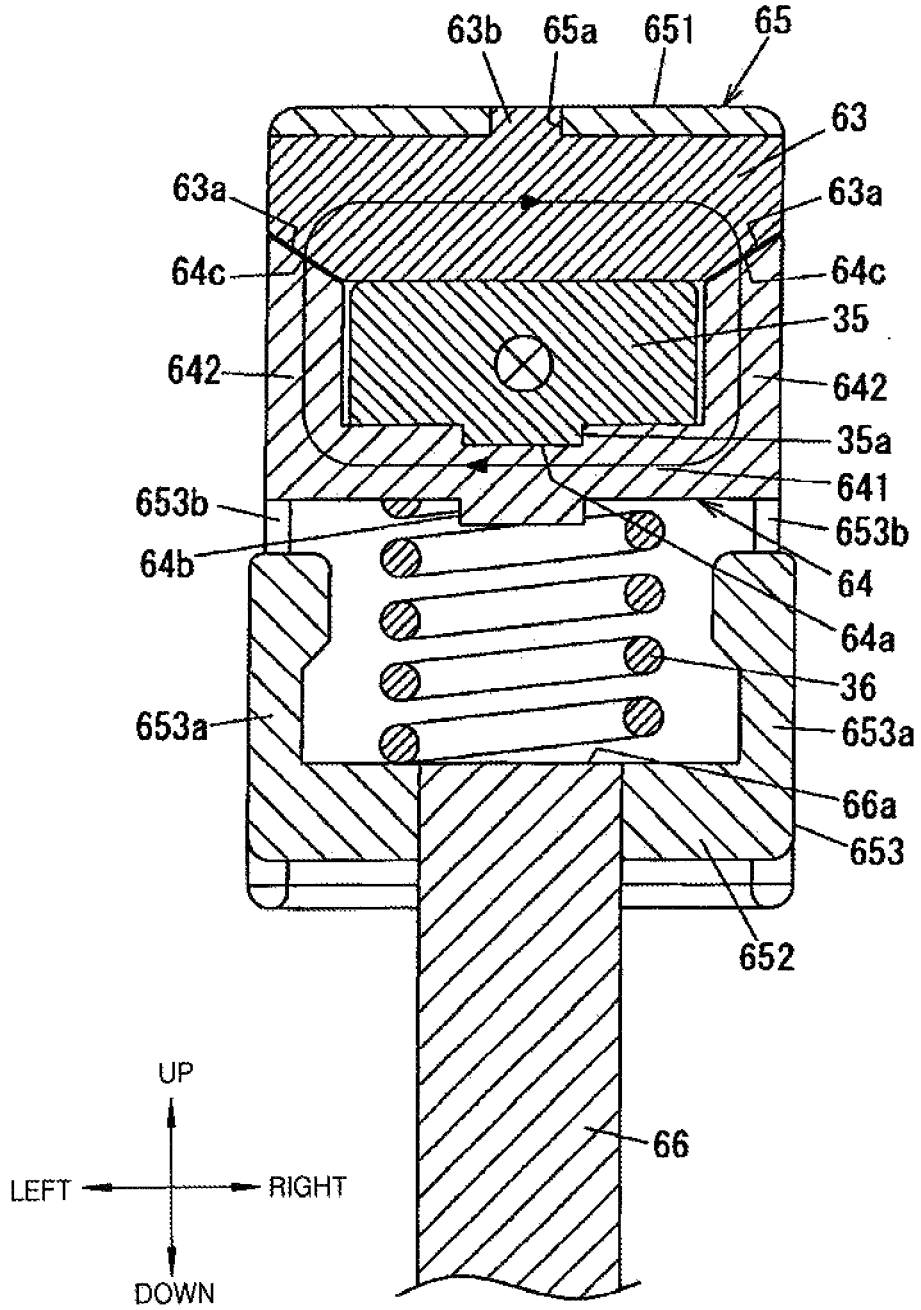
FIG. 15 is a section view of the contact apparatus according to the fourth embodiment.

As shown in FIG. 15, slant portions 63*a* inclined upward toward the front and rear tip ends of the yoke plate 63 are formed at the front and rear opposite ends of the lower surface of the yoke plate 63. A protrusion portion (third protrusion portion) 63*b* having a substantially rectangular plate shape protrudes from the substantially central region of the upper surface of the yoke plate 63.

Figure 14:
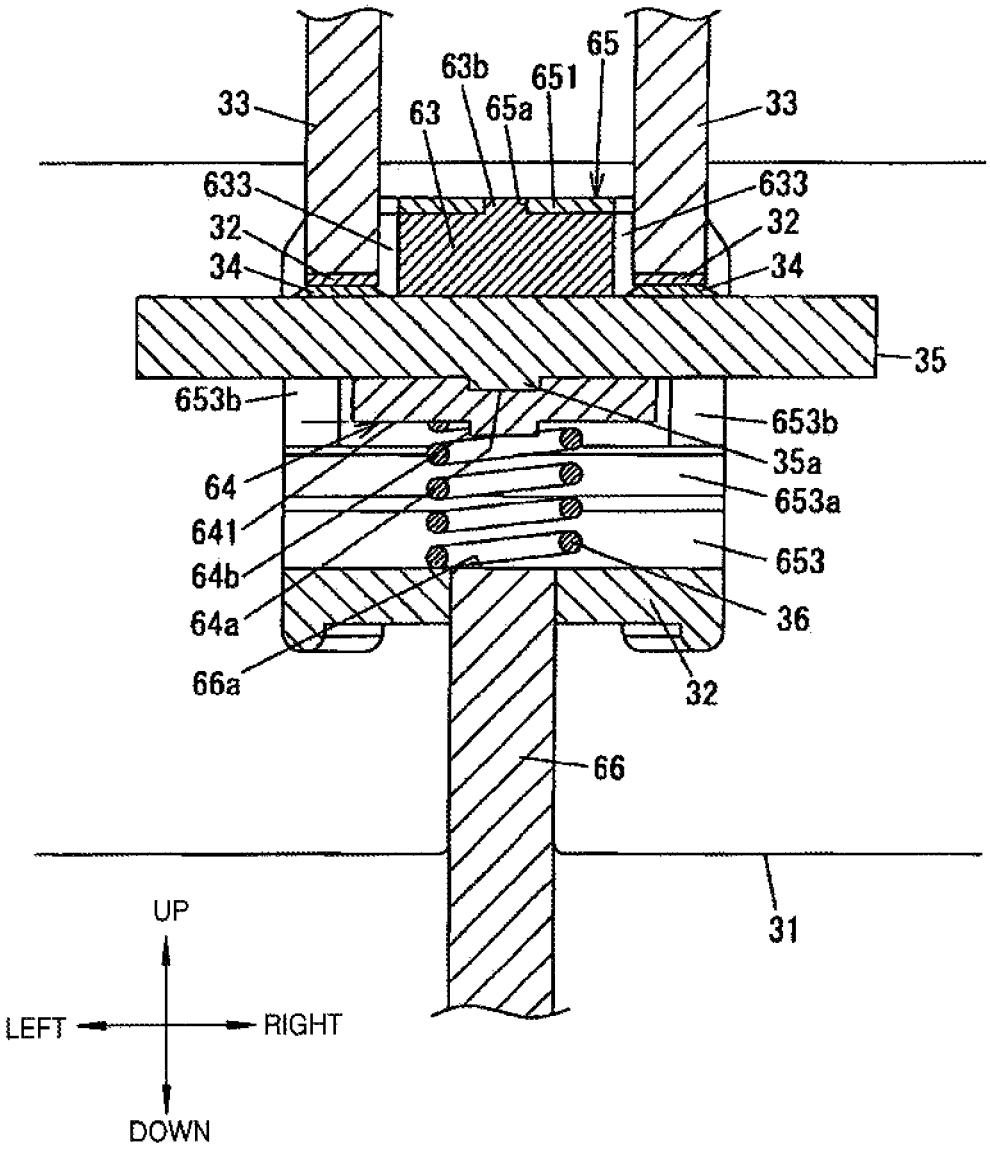
FIG. 14 is a section view of the contact apparatus according to the fourth embodiment.

As shown in FIGS. 13 and 14, the yoke plate (second yoke) 64 is made of a magnetic material such as soft iron or the like and is formed into a substantially U-like shape. The yoke plate 64 includes a base plate 641 of rectangular plate shape extending in the front-rear direction and a pair of extension walls 642 extending upward from the front and rear opposite ends of the base plate 641.

A recess portion 64*a* having a substantially rectangular plate shape is formed in the substantially central region of the upper surface of the base plate 641. A raised portion 64*b* having a substantially disc-like shape is formed in the substantially central region of the lower surface of the base plate 641. The positioning protrusion portion 35*a* of the movable contact member 35 is fitted to the recess portion 64*a*, whereby the base plate 641 is positioned in place on the lower surface of the movable contact member 35.

Slant portions 64*c* are formed in the tip end portions of the extension walls 642 in an opposing relationship with the front and rear ends of the movable contact member 35. The slant portions 64*c* are inclined upward toward the front and rear tip ends of the extension walls 642. The slant portions 64*c* are formed substantially parallel to the slant portions 63*a* of the yoke plate 63 to face the slant portions 63*a*.

The holding member 65 includes a top plate 651, a bottom plate 652 arranged below the top plate 651 to face the top plate 651 in the up-down direction, and a pair of side plates 653 interconnecting the top plate 651 and the bottom plate 652 and facing each other in the front-rear direction. The holding member 65 is formed into a substantially rectangular frame shape.

The top plate 651 is formed into a substantially double-headed drum shape to have a width growing larger from the substantially central region in the front-rear direction toward the front and rear tip ends. An insertion hole (third recess portion) 65*a* having a substantially rectangular shape is formed in the substantially central region of the top plate 651.

The bottom plate 652 is formed into a substantially rectangular plate shape. An insertion hole 65*b*, into which the movable shaft 66 is inserted, is formed in the substantially central region of the bottom plate 652. The movable shaft 66 is formed into the shape of a rod extending in the up-down direction. The electromagnet block 2 is connected to the lower end of the movable shaft 66. The upper end portion of the movable shaft 66 is inserted into the insertion hole 65*b* from below and is fixed in a position where the upper end of the movable shaft 66 becomes flush with the upper surface of the bottom plate 652.

Each of the side plates 653 includes an extension wall 653*a* of substantially rectangular plate shape extending upward from each of the front and rear opposite ends of the bottom plate 652 and a pair of connecting members 653*b* of band-like shape extending upward from the left and right ends of the extension wall 653*a*. The connecting members 653*b* are connected to the top plate 651. A hole (cutout) 65*c* having a substantially rectangular shape is defined by the connecting members 653*b*, the extension wall 653*a*, and the top plate 651.

The yoke plate 63, the movable contact member 35, the yoke plate 64, and the contact pressure spring 36 are arranged within the holding member 65 in the named order from above. The yoke plate 63 is positioned in place in the holding member 65 by inserting the protrusion portion 63*b* of the yoke plate 63 into the insertion hole 65*b* of the top plate 651 and fitting the front and rear end portions of the yoke plate 63 to the holes 65*c* of the side plates 653. The yoke plate 63 is fixed to the holding member 65 by, e.g., welding.

The movable contact member 35 is arranged between the side plates 653. The movable contacts 34 face the fixed contacts 32 with a specified gap left therebetween. The upper surface of the movable contact member 35 faces the lower surface of the yoke plate 63. The yoke plate 64 faces the yoke plate 63 through the movable contact member 35. The extension walls 642 are inserted into the holes 65*c*. The slant portions 64*c* of the yoke plate 64 face the slant portions 63*a* of the yoke plate 63. Since the extension walls 642 make sliding contact with the side edge of the holes 65*c*, the yoke plate 64 is prevented from being out of alignment.

The raised portion 64*b* of the yoke plate 64 is inserted into the upper end of the bore of the contact pressure spring 36, whereby the contact pressure spring 36 is positioned with respect to the yoke plate 64. The lower end of the contact pressure spring 36 makes contact with the upper surface of the bottom plate 652. The contact pressure spring 36 is arranged between the yoke plate 64 and the bottom plate 652 of the holding member 65 in a compressed state. The contact pressure spring 36 presses the movable contact member 35 upward through the yoke plate 64. The movable contact member 35 makes contact with the yoke plate 63 fixed to the top plate 651. Thus the movable contact member 35 is restrained from moving upward.

In the contact apparatus of the present embodiment configured as above, if the movable shaft 66 is displaced upward by the drive means 2, the holding member 65 connected to the movable shaft 66 is also displaced upward. In response to this displacement, the yoke plate 63 fixed to the holding member 65 is moved upward. The movable contact member 35 is also moved upward together with the yoke plate 64. As a consequence, the movable contacts 34 make contact with the fixed contacts 32, whereby the movable contacts 34 and the fixed contacts 32 are electrically connected to each other. If an electric current flows through the movable contact member 35, magnetic fields are generated around the movable contact member 35 as shown in FIG. 15. Magnetic fluxes passing through the yoke plates 63 and 64 are formed.

In the contact apparatus of the present embodiment, just like the contact apparatus of the second embodiment, the yoke plate 63 is formed into a substantially double-headed drum shape. It is therefore possible to increase the volume of the yoke plate 63 while preventing the yoke plate 63 from interfering with the fixed terminals 33. It is also possible to apply not only the magnetic attraction force but also the upward electromagnetic force to the movable contact member 35. Since the volume of the yoke plate 63 can be increased and the electromagnetic force can be generated without having to increase the thickness of the yoke plate 63, it is possible to prevent the contact apparatus from becoming larger in the up-down size. Accordingly, the contact apparatus of the present embodiment is capable of obtaining a large contact pressure while suppressing an increase in size.

Figure 17:
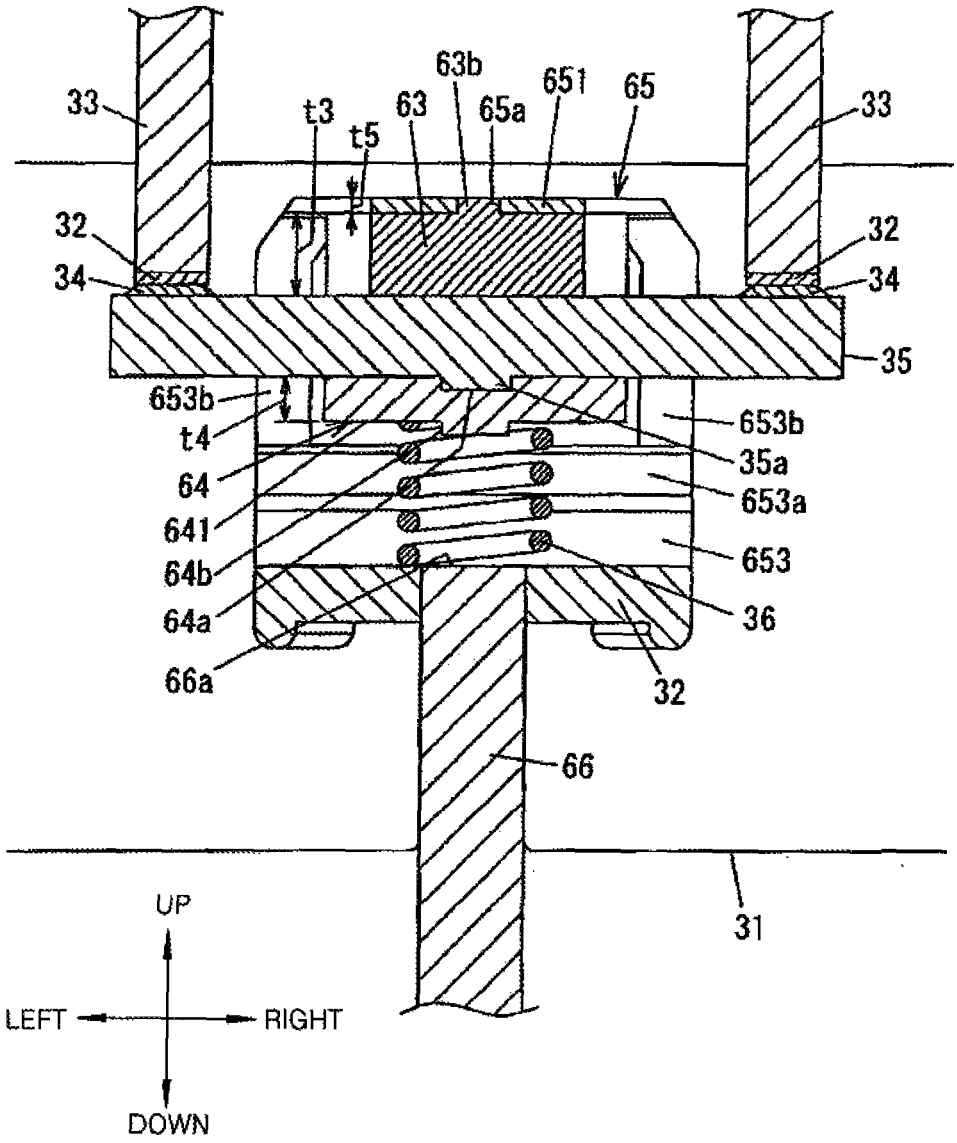
FIG. 17 is a section view showing a contact apparatus employing the yoke plates 6 and 63 of the contact apparatus according to the first embodiment.
Figure 18:
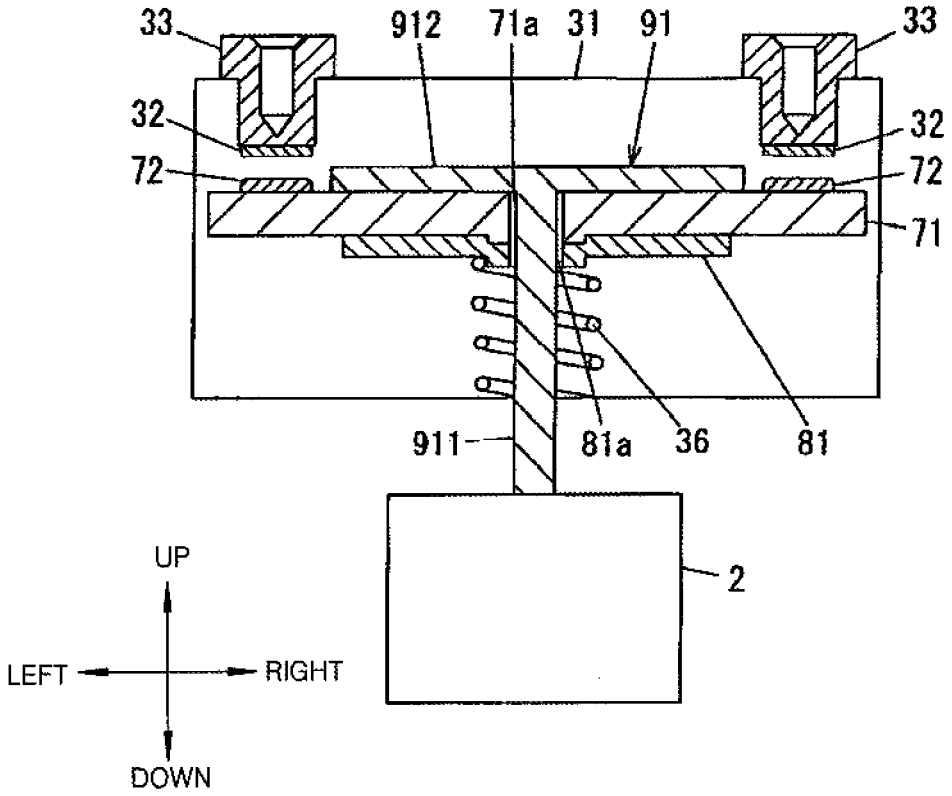
FIG. 18 (PRIOR ART)
FIG. 18 is a section view showing a contact apparatus according to a prior art example.

While the contact apparatus of the present embodiment is provided with the yoke plate 63 of the second embodiment having a substantially double-headed drum shape, it will be apparent to those skilled in the art that, as shown in FIG. 17, the contact apparatus of the present embodiment may be provided with the yoke plate 63 of the first embodiment having a thickness t3 twice as large as the thickness t4 of the yoke plate 64. No detailed description will be made on the contact apparatus of the present embodiment provided with the yoke plate 63 of the first embodiment.

In the contact apparatus of the present embodiment, as described above, the holes 65*c* are formed in the side plates 653 of the holding member 65. The front and rear end portions of the yoke plates 63 and 64 are inserted into the holes 65*c*. Accordingly, it is possible to increase the front-rear dimension of the yoke plates 63 and 64 without having to increase the front-rear dimension of the contact apparatus. It is also possible to increase the magnetic attraction force acting between the yoke plates 63 and 64. This makes it possible to increase the contact repulsion resistance.

Figure 16A:
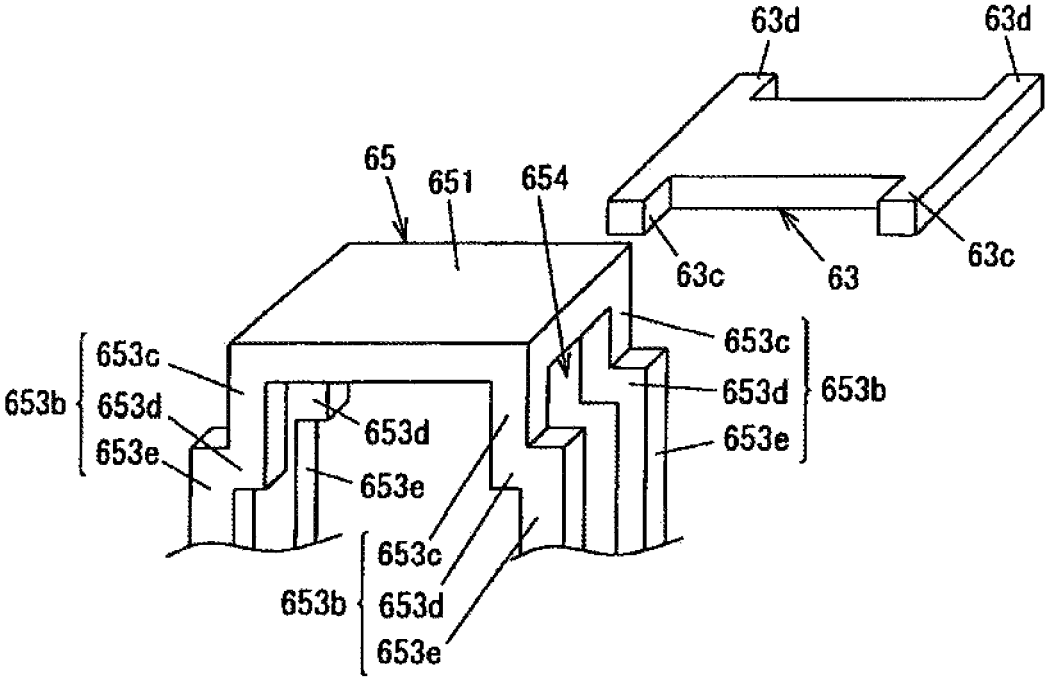
FIGS. 16A and 16B are enlarged views of certain major portions of a modified example of the contact apparatus according to the fourth embodiment.
Figure 16B:
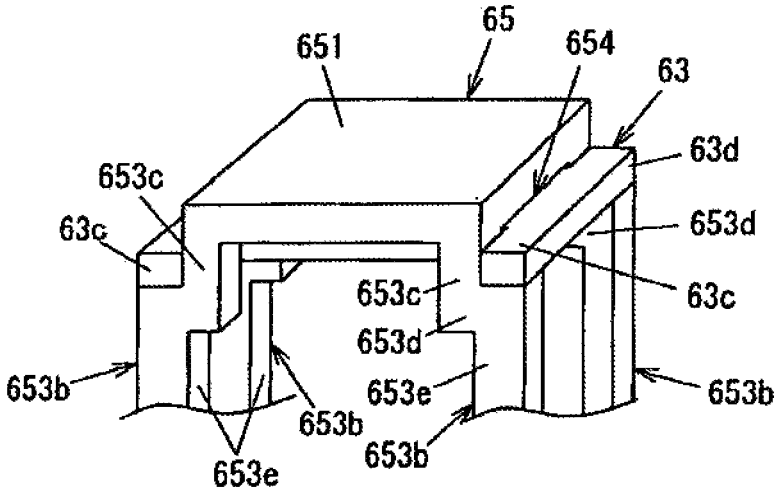

In the present embodiment, the yoke plate 63 is fixed to the holding member 65 by welding. However, the fixing method is not limited thereto but may be bonding, caulking or engaging. One example of the engaging method is shown in FIG. 16A. As shown in FIG. 16A, engaged portions 654 are formed in the connecting members 653*b* and engaging lug portions 63*c* and 63*d* are formed in the yoke plate 63. The engaging lug portions 63*c* and 63*d* are brought into engagement with the engaged portions 654.

More specifically, each of the connecting members 653*b* includes extension pieces 653*c* extending downward from the top plate 651, connecting pieces 653*d* extending outward in the left-right direction from the tip ends of the extension pieces 653*c*, and extension pieces 653*e* extending downward from the tip ends of the connecting pieces 653*d* and connected to the extension walls 653*a*.

Engaging lug portions 63*c* protruding forward and engaging lug portions 63*d* protruding backward are formed in the left and right end portions of the yoke plate 63. Thus the yoke plate 63 is formed into a substantially H-like shape.

As shown in FIG. 12B, the yoke plate 63 is inserted between the connecting members 653*b* such that the left and right ends of the yoke plate 63 protrude from between the extension pieces 653*c* and such that the engaging lug portions 63*c* and 63*d* protrude toward the upper ends of the connecting pieces 653*d*. As a result, the engaging lug portions 63*c* and 63*d* come into engagement with the engaged portions 654 defined by the top plate 651, the extension pieces 653*c*, and the connecting pieces 653*d*. Thus the yoke plate 63 is brought into engagement with and fixed to the holding member 65. The engaging method is not limited to the method mentioned just above.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A contact apparatus comprising:

fixed terminals having fixed contacts;

a movable contact member having movable contacts provided on one surface thereof so as to come into contact or out of contact with the fixed contacts;

a first yoke arranged at one side of said one surface of the movable contact member;

a second yoke arranged at a side of the other surface of the movable contact member, the second yoke having one surface facing the first yoke through the movable contact member;

a contact pressure spring configured to bias the movable contact member toward the fixed contacts through the second yoke;

a movable shaft; and a drive unit configured to drive the movable shaft so that the movable contacts come into contact or out of contact with the fixed contacts, wherein the first yoke is larger in volume than the second yoke.

2. The contact apparatus of claim 1, wherein the first yoke is larger in thickness than the second yoke.

3. The contact apparatus of claim 1, wherein the first yoke has a thickness twice as large as the thickness of the second yoke.

4. The contact apparatus of claim 1, wherein the first yoke includes: a first enlarged width portion formed at one end of the first yoke in a third direction orthogonal to a first direction along which the movable contacts are arranged and orthogonal to a second direction as a thickness direction of the movable contact member, the first enlarged width portion having a width in the first direction growing larger toward said one end of the first yoke; and a second enlarged width portion formed at the other end of the first yoke, the second enlarged width portion having a width in the first direction growing larger toward the other end of the first yoke.

5. The contact apparatus of claim 1, wherein the movable contact member is configured such that, when energized, magnetic fluxes passing through the first yoke and the second yoke are generated around the movable contact member, the first yoke having first taper surfaces formed in magnetic-flux incoming and outgoing portions on one surface of the first yoke, the second yoke having second taper surfaces formed on said one surface of the second yoke in an opposing relationship with the first taper surfaces, the second taper surfaces being parallel to the first taper surfaces.

6. The contact apparatus of claim 1, wherein the other surface of the movable contact member makes contact with said one surface of the second yoke, one of the other surface of the movable contact member and said one surface of the second yoke having a first protrusion portion, the other of the other surface of the movable contact member and said one surface of the second yoke having a first recess portion to which the first protrusion portion is fitted.

7. The contact apparatus of claim 1, wherein the second yoke has a second protrusion portion formed on the other surface thereof, the contact pressure spring being formed of a coil spring, the second protrusion portion being fitted to one end of a bore of the contact pressure spring.

8. The contact apparatus of claim 1, wherein the movable contact member has an insertion hole, the movable shaft including a shaft portion movably inserted into the insertion hole and a contact portion provided at one end of the shaft portion to restrain the movable contact member from moving toward the fixed contacts.

9. The contact apparatus of claim 1, further comprising:

a holding member including a top plate, a bottom plate, and a pair of side plates configured to interconnect the top plate and the bottom plate, the holding member being formed into a substantially rectangular frame shape, the movable contact member being arranged between the side plates, one surface of the first yoke making contact with the top plate of the holding member such that the first yoke is held by the holding member, one end of the contact pressure spring making contact with the other surface of the second yoke, the other end of the contact pressure spring making contact with the bottom plate of the holding member, the movable shaft being connected to the holding member.

10. The contact apparatus of claim 9, wherein one of said one surface of the first yoke and the top plate of the holding member making contact with said one surface of the first yoke has a third protrusion portion, and the other of said one surface of the first yoke and the top plate of the holding member has a third recess portion to which the third protrusion portion is fitted.

11. The contact apparatus of claim 9, wherein the side plates have cutouts formed to extend from an inner surface thereof in a thickness direction, the first yoke and the second yoke having side end portions arranged in the cutouts.

12. The contact apparatus of claim 11, wherein the first yoke has opposite end portions fitted to the cutouts.

13. The contact apparatus of claim 11, wherein the second yoke has opposite end portions making sliding contact with side edges of the cutouts.

14. The contact apparatus of claim 9, wherein the first yoke engages with the holding member.

* * * * *